US011739403B2

(12) United States Patent
Mori et al.

(10) Patent No.: US 11,739,403 B2
(45) Date of Patent: Aug. 29, 2023

(54) SOFT MAGNETIC METAL POWDER AND MAGNETIC COMPONENT

(71) Applicant: TDK CORPORATION, Tokyo (JP)

(72) Inventors: Satoko Mori, Tokyo (JP); Kazuhiro Yoshidome, Tokyo (JP); Hiroyuki Matsumoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 473 days.

(21) Appl. No.: 16/829,074

(22) Filed: Mar. 25, 2020

(65) Prior Publication Data

US 2020/0306831 A1 Oct. 1, 2020

(30) Foreign Application Priority Data

Mar. 28, 2019 (JP) ..... 2019-064223
Feb. 13, 2020 (JP) ..... 2020-022600

(51) Int. Cl.

| | |
|---|---|
| ***C22C 38/16*** | (2006.01) |
| ***H01F 1/147*** | (2006.01) |
| ***B22F 9/08*** | (2006.01) |
| ***C22C 38/12*** | (2006.01) |
| ***C22C 38/00*** | (2006.01) |
| ***H01F 1/153*** | (2006.01) |
| ***C22C 38/02*** | (2006.01) |

(Continued)

(52) U.S. Cl.

CPC ..... *C22C 38/16* (2013.01); *B22F 1/08* (2022.01); *B22F 1/16* (2022.01); *B22F 9/082* (2013.01); *C22C 38/002* (2013.01); *C22C 38/02* (2013.01); *C22C 38/12* (2013.01); *H01F 1/14766* (2013.01); *H01F 1/15308* (2013.01);

(Continued)

(58) Field of Classification Search

CPC ..... H01F 1/153–33

See application file for complete search history.

(56) References Cited

U.S. PATENT DOCUMENTS

2004/0140016 A1* 7/2004 Sakamoto ..... H01F 1/15308 148/403
2011/0272065 A1* 11/2011 Ohta ..... C21D 8/1211 148/540

(Continued)

FOREIGN PATENT DOCUMENTS

JP 3342767 B2 11/2002
JP 2015-233118 A 12/2015

(Continued)

*Primary Examiner* — Kevin E Yoon
*Assistant Examiner* — Austin Pollock
(74) *Attorney, Agent, or Firm* — Oliff PLC

(57) ABSTRACT

A soft magnetic metal powder that has low coercivity Hcj and high saturation magnetic flux density Bs, and has high powder resistivity and high insulating performance is obtained. The soft magnetic metal powder is soft magnetic metal powder containing Fe. The soft magnetic metal powder has particles each including a soft magnetic metal portion and a coating portion coating the soft magnetic metal portion. The coating portion includes a first coating portion and a second coating portion. The first coating portion is closer to the soft magnetic metal portion than the second coating portion. The first coating portion and the second coating portion have oxides containing at least one element selected from Si, Fe, and B as a main component. The first coating portion includes amorphous material, the second coating portion includes crystals, and the second coating portion has a higher crystal content ratio than the first coating portion.

8 Claims, 16 Drawing Sheets

(51) Int. Cl.

| | |
|---|---|
| ***H01F 1/33*** | (2006.01) |
| ***H01F 1/36*** | (2006.01) |
| ***B22F 1/16*** | (2022.01) |
| ***H01F 1/20*** | (2006.01) |
| ***H01F 1/24*** | (2006.01) |
| ***B22F 1/08*** | (2022.01) |

(52) U.S. Cl.
CPC ..... *H01F 1/15333* (2013.01); *H01F 1/15341* (2013.01); *H01F 1/20* (2013.01); *H01F 1/24* (2013.01); *H01F 1/33* (2013.01); *H01F 1/36* (2013.01); *B22F 2301/35* (2013.01); *C22C 2200/02* (2013.01); *C22C 2200/04* (2013.01); *C22C 2202/02* (2013.01)

(56) References Cited

U.S. PATENT DOCUMENTS

| | | | | |
|---|---|---|---|---|
| 2012/0082844 | A1* | 4/2012 | Takahashi | B22F 1/16 428/336 |
| 2015/0332823 | A1 | 11/2015 | Sakurai et al. | |
| 2016/0151836 | A1* | 6/2016 | Matsutani | C22C 38/02 252/62.55 |
| 2017/0032880 | A1 | 2/2017 | Jeong | |
| 2018/0169759 | A1 | 6/2018 | Nakamura et al. | |
| 2018/0361474 | A9 | 12/2018 | Nakamura et al. | |
| 2018/0374619 | A1* | 12/2018 | Orimo | H01F 1/38 |
| 2019/0013127 | A1* | 1/2019 | Maede | B22F 1/16 |
| 2021/0031268 | A1 | 2/2021 | Nakamura et al. | |
| 2021/0313100 | A1* | 10/2021 | Ishida | B22F 1/16 |

FOREIGN PATENT DOCUMENTS

| | | | |
|---|---|---|---|
| JP | 2017-034228 | A | 2/2017 |
| JP | 6075605 | B2 | 2/2017 |
| JP | 2018-011043 | A | 1/2018 |
| JP | 2019-024076 | A | 2/2019 |
| KR | 10-2018-0034532 | A | 4/2018 |
| KR | 10-2019-0001522 | A | 1/2019 |

* cited by examiner

SOFT MAGNETIC METAL POWDER AND MAGNETIC COMPONENT

BACKGROUND OF THE INVENTION

The present invention relates to soft magnetic metal powder and a magnetic component.

Patent Document 1 describes an Fe—B-M-based soft magnetic amorphous alloy. The soft magnetic amorphous alloy has excellent soft magnetic properties such as a high saturation magnetic flux density as compared with an Fe-based amorphous alloy.

Patent Document 2 describes that a first insulating layer including Si and O disposed on the surface of each of magnetic metal particles, and a second insulating layer including P disposed on the first insulating layer are provided. Magnetic powder having these magnetic metal particles has high insulating performance.

[Patent Document 1] Japanese Patent No. 3342767

[Patent Document 2] Japanese Patent Laid-Open No. 2017-34228

BRIEF SUMMARY OF INVENTION

At present, there is a need for soft magnetic metal powder which has excellent soft magnetic properties, that is, low coercivity Hcj and high saturation magnetic flux density Bs, and has high powder resistivity and high insulating performance.

An object of the present invention, which has been made in view of such circumstances, is to obtain soft magnetic metal powder having excellent soft magnetic properties and a high powder resistivity.

In order to attain the above object, a soft magnetic metal powder according to the present invention is a soft magnetic metal powder containing Fe, wherein the soft magnetic metal powder comprises particles each including a soft magnetic metal portion, and a coating portion coating the soft magnetic metal portion;

the coating portion comprises a first coating portion and a second coating portion;

the first coating portion is closer to the soft magnetic metal portion than the second coating portion;

the first coating portion and the second coating portion include oxides containing at least one element selected from Si, Fe, and B as a main component;

the first coating portion includes amorphous material, and the second coating portion includes crystals; and the second coating portion has a higher crystal content ratio than the first coating portion.

The soft magnetic metal powder according to the present invention has the above-mentioned properties, so that the soft magnetic metal powder has enhanced powder resistivity while having excellent soft magnetic properties.

The soft magnetic metal powder may contain B, and $0.5 \leq B_B/B_A \leq 10$ may be satisfied, in which an average value of a concentration of B in the soft magnetic metal portion is represented by $B_A$, and an average value of a concentration of B in the first coating portion and the second coating portion is represented by $B_B$.

The soft magnetic metal portion may include amorphous material.

The soft magnetic metal portion may include nanocrystals.

$0.2 \leq D_2/D_1 \leq 8.0$ may be satisfied, in which an average value in thickness of the first coating portion is represented by $D_1$, and an average value in thickness of the second coating portion is represented by $D_2$.

The soft magnetic metal powder may contain Si, and $0.5 \leq Si_B/Si_A \leq 50$ may be satisfied, in which an average value of a concentration of Si in the soft magnetic metal portion is represented by $Si_A$, and an average value of a concentration of Si in the first coating portion and the second coating portion is represented by $Si_B$.

The coating portion may further comprise a third coating portion outside the second coating portion.

A magnetic component according to the present invention comprises the above-described soft magnetic metal powder.

DETAILED DESCRIPTION OF INVENTION

An embodiment of the present invention will be described with reference to the drawings.

(Structure of Particle 1)

Figure 1:
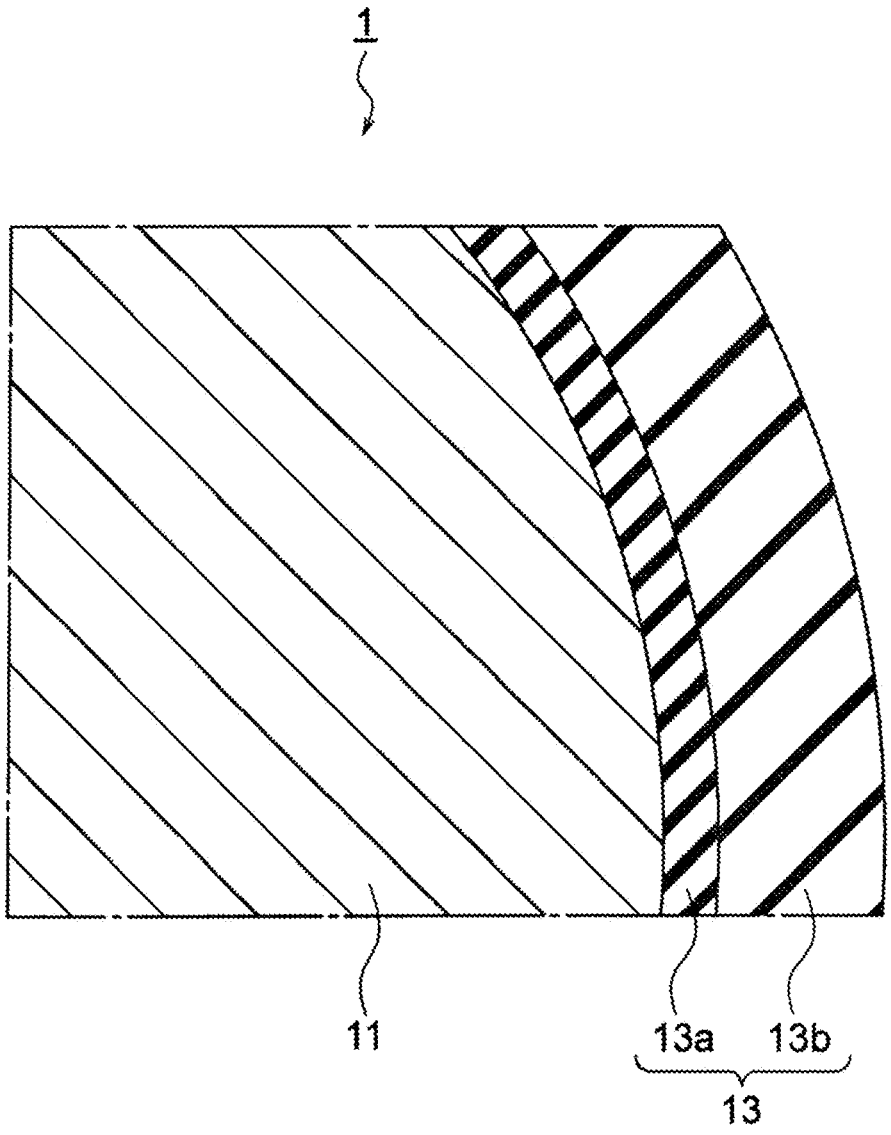
FIG. 1 is a schematic cross-sectional diagram of a portion near the surface of a particle.

Soft magnetic metal powder according to the present embodiment has particles 1 each having a structure shown in FIG. 1 near the surface thereof. In other words, the soft magnetic metal powder according to the present embodiment has the particles 1 each including a soft magnetic metal portion 11 and a coating portion 13 coating the soft magnetic metal portion 11. Further, the coating portion 13 includes a first coating portion 13*a* and a second coating portion 13*b*, and the first coating portion 13*a* is closer to the soft magnetic metal portion 11 than the second coating portion 13*b*.

No particular limitation is imposed on a method of checking whether the coating portion 13 has the first coating portion 13*a* and the second coating portion 13*b*. For example, there is a method of checking by using TEM and an electron energy loss spectroscopy (EELS) as described later.

No particular limitation is imposed on the average grain size of the particles 1 in the soft magnetic metal powder according to the present embodiment. For example, the average grain size may be in the range from 0.1 μm or more to 100 μm or less. Further, the average value $D_1$ of the thickness of the first coating portion 13*a* may be in the range from 0.5 nm or more to 20 nm or less, and the average value $D_2$ of the thickness of the second coating portion 13*b* may be in the range from 0.5 nm or more to 20 nm or less.

$0.2 \leq D_2/D_1 \leq 8.0$ may be satisfied, and $0.4 \leq D_2/D_1 \leq 6.0$ may be satisfied. When $D_2/D_1$ is within the above range, both a withstand voltage characteristic and a magnetic permeability tend to be satisfiable. Note that no particular limitation is imposed on a method of calculating $D_1$ and $D_2$. For example, $D_1$ and $D_2$ may be calculated by determining the ranges of the first coating portion 13*a* and the second coating portion 13*b* by using TEM, fast Fourier transform processing (FFT) on a TEM image, EELS, and the like, measuring thicknesses at least at 50 places for each of the first coating portion 13*a* and the second coating portion 13*b*, and averaging the thicknesses.

The first coating portion 13*a* and the second coating portion 13*b* include oxides of at least one element selected from Si, Fe, and B as a main component. Specifically, the amount of the oxide over the entire first coating portion 13*a* is 70 mass % or more, and the amount of the oxide over the entire second coating portion 13*b* is 70 mass % or more. The coating portion 13 is not required to coat the entire surface of the soft magnetic metal portion 11, and may coat at least 60% or more of the entire surface of the soft magnetic metal portion 11.

Further, the coating portion 13 may include a third coating portion (not shown in FIG. 1) on the outside of the second coating portion 13*b*.

No particular limitation is imposed on the thickness of the third coating portion. For example, the average value $D_3$ of the thickness of the third coating portion may be set in the range from 5 nm or more to 100 nm or less.

No particular limitation is imposed on the material of the third coating portion. For example, an insulating coating which has been commonly used in the present technical field may be used. Specifically, the third coating portion may be an $SiO_2$ glass coating or a phosphate glass coating. Further, the third coating portion may be formed of two or more layers which are made of different kinds of materials.

When the particle 1 has the third coating portion, the powder resistivity of the soft magnetic metal powder having the particles 1 increases.

Not all the particles contained in the soft magnetic metal powder according to the present embodiment may have the structure of the particle 1 described above. However, particles of 50% or more on the number of basis with respect to all the particles contained in the soft magnetic metal powder may have the above-described structure of the particle 1.

(Microstructure of Soft Magnetic Metal Portion 11)

The microstructure of the soft magnetic metal portion 11 is arbitrary. For example, the soft magnetic metal portion 11 may have an amorphous structure, or may have a nanocrystal structure. When the soft magnetic metal portion 11 of the particle 1 has the above-described microstructure, Hcj can be reduced and thus the soft magnetic properties can be enhanced as compared with a case where the soft magnetic metal portion 11 has crystals larger than the nanocrystals. Further, the nanocrystals are crystals whose crystal grain sizes are, for example, 0.1 nm or more and 100 nm or less. In particles containing nanocrystals, it is normal that multiple nanocrystals are contained in one particle. In other words, the grain size of the particle is different from the crystal grain size.

No particular limitation is imposed on a method of checking the microstructure of the soft magnetic metal portion 11. For example, the microstructure of the soft magnetic metal portion 11 can be checked by XRD. In the following method, the microstructure of the soft magnetic metal portion 11 can be checked regardless of the microstructure of the coating portion 13. This is because the existence ratio of the coating portion 13 is smaller than the existence ratio of the soft magnetic metal portion 11, so that the microstructure of the coating portion 13 is not reflected in the measurement result by XRD.

In the present embodiment, it is assumed that soft magnetic metal portions 11 included in soft magnetic metal powder in which an amorphization ratio X represented by the following equation (1) is 85% or more have amorphous structures, and soft magnetic metal portions 11 included in soft magnetic alloy powder in which the amorphization ratio X is less than 85% have a crystalline structure.

$$X = 100 - (Ic/(Ic+Ia) \times 100) \quad (1)$$

Ic: crystalline scattering integrated intensity

Ia: amorphous scattering integrated intensity

The amorphization ratio X is determined by performing X-ray crystal structure analysis on soft magnetic alloy powder by XRD, identifying a phase, and reading peaks of crystallized Fe or compounds (Ic: crystalline scattering integrated intensity, Ia: amorphous scattering integrated intensity), estimating a crystallization rate from the peak intensities, and calculating the amorphization ratio X with the above equation (1). Hereinafter, a calculation method will be described more specifically.

Figure 2:
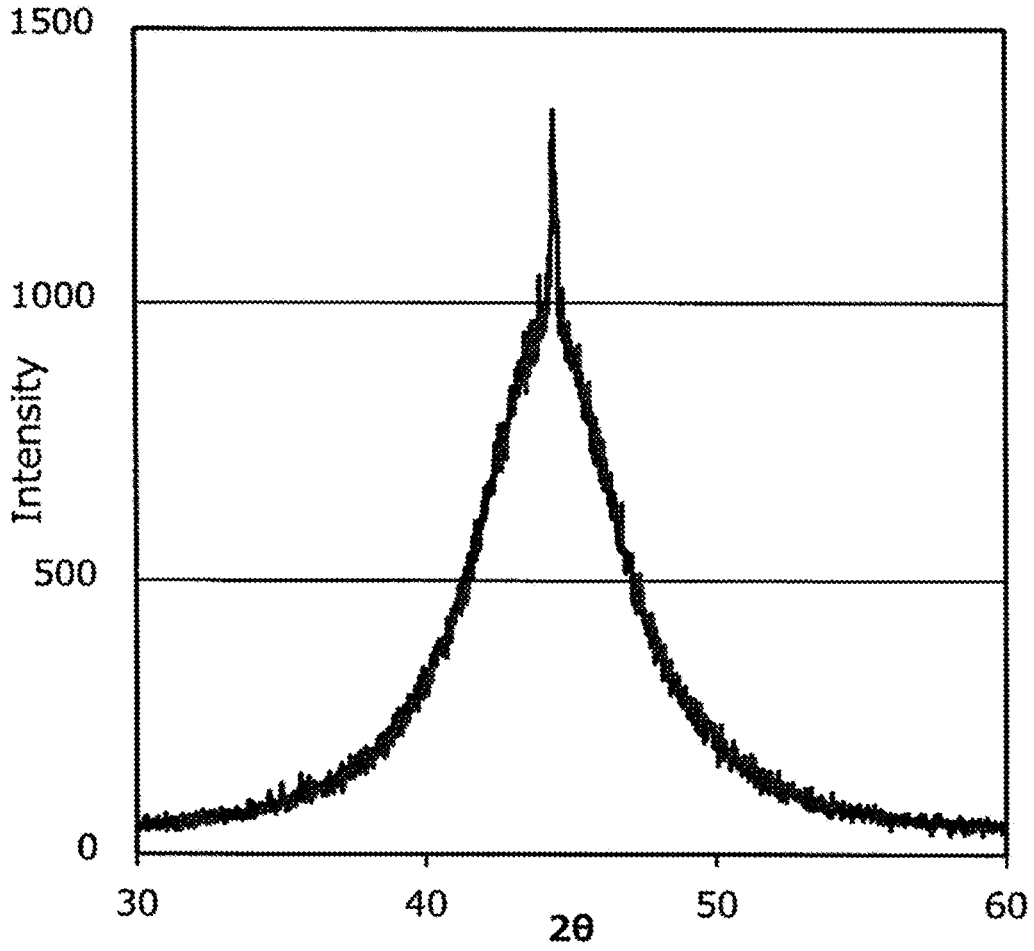
FIG. 2 is an example of a chart obtained by X-ray crystal structure analysis.
Figure 3:
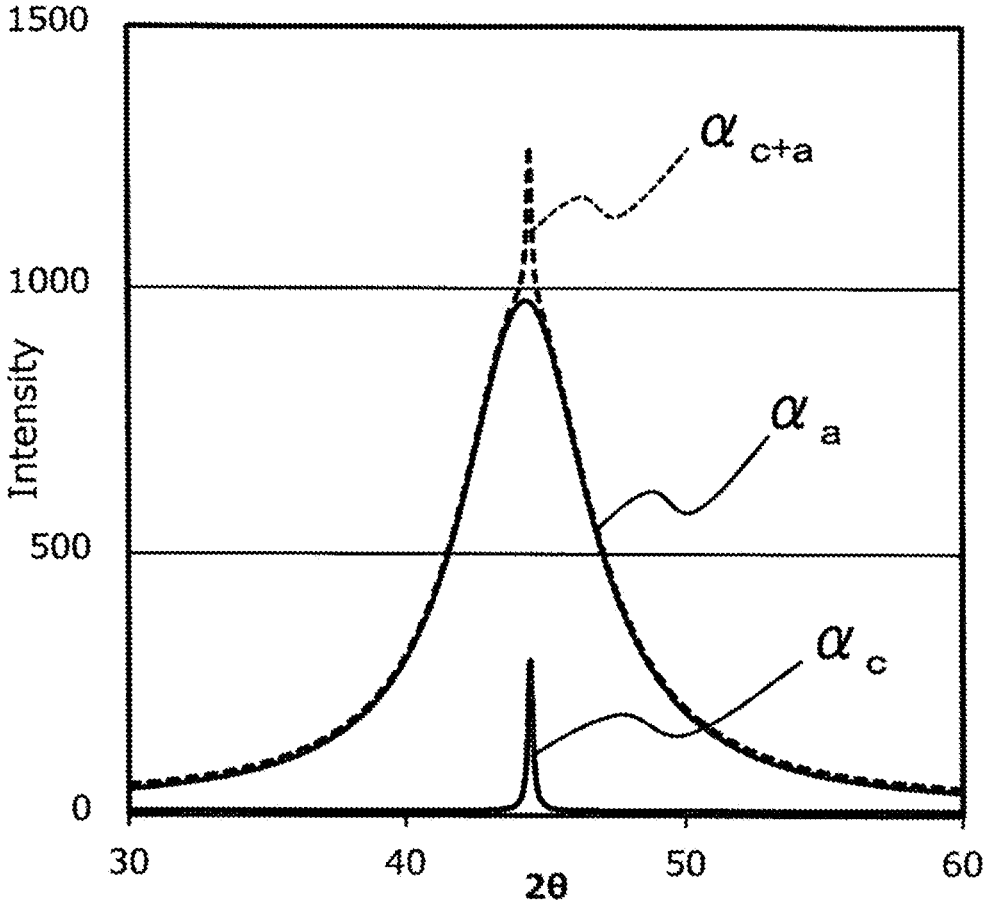
FIG. 3 is an example of a pattern obtained by profile-fitting the chart of FIG. 2.

An X-ray crystal structure analysis is conducted on the soft magnetic alloy powder according to the present embodiment by XRD to obtain a chart as shown in FIG. 2. This chart is subjected to profile fitting by using a Lorentz function of the following equation (2) to obtain a crystal component pattern $\alpha_c$ indicating a crystalline scattering integrated intensity, an amorphous crystal pattern $\alpha_a$ indicating an amorphous scattering integrated intensity, and a pattern $\alpha_{c+a}$ of the combination of the crystal component pattern $\alpha_c$, and the amorphous crystal pattern $\alpha_a$ as shown in FIG. 3. The amorphization ratio X is determined from the crystalline scattering integrated intensity and the amorphous scattering integrated intensity of the obtained pattern according to the above equation (1). Note that the measurement range is set to a range of a diffraction angle 2θ=30° to 60° in which a halo derived from amorphous can be confirmed. The error between the actually measured integrated intensity by XRD and the integrated intensity calculated by using the Lorentz function was set to be within 1% in the above range.

$$f(x) = \frac{h}{1 + \frac{(x-u)^2}{w^2}} + b \quad (2)$$

*h*: peak height

*u*: peak position

*w*: half-value width

*b*: background height

Hereinafter, the nanocrystal will be described in more detail.

The nanocrystals included in the soft magnetic metal portion 11 of the present embodiment may be Fe-based nanocrystals. The Fe-based nanocrystal is a crystal which has a nanometer-order grain size and has a crystal structure of Fe which is bcc (body-centered cubic lattice structure). No particular limitation is imposed on a method of calculating the average crystal grain size of the Fe-based nanocrystals. For example, the average crystal grain size can be calculated by observation using TEM. Further, no particular limitation is imposed on a method for checking whether the crystal structure is bcc or not. For example, it can be checked by using XRD.

In the present embodiment, the average crystal grain size of the Fe-based nanocrystal may be in the range of 5 to 30 nm. Soft magnetic metal powder containing such Fe-based nanocrystals tends to have a high Bs and a low Hcj. In other words, the soft magnetic properties thereof are easily enhanced.

(Microstructure of Coating Portion 13)

The coating portion 13 of the particle 1 included in the soft magnetic metal powder according to the present embodiment has a microstructure in which the first coating portion 13*a* contains amorphous material and the second coating portion 13*b* contains crystals. The second coating portion 13*b* has a higher crystal content ratio than the first coating portion 13*a*.

When the coating portion 13 of the particle 1 has the above microstructure, the soft magnetic metal powder has enhanced powder resistivity while having excellent soft magnetic properties. Therefore, use of the soft magnetic metal powder of the present embodiment makes it easier to obtain green compact having high electric resistance.

It is preferable that the first coating portion 13*a* substantially includes only amorphous material. When the first coating portion 13*a* substantially includes only amorphous material, it is easy to obtain green compact having higher resistance. Note that the fact that the first coating portion 13*a* is substantially made of only amorphous material means that no crystalline spot is observed from the first coating portion 13*a* by FFT.

No particular limitation is imposed on a method of checking the microstructures of the first coating portion 13*a* and the second coating portion 13*b*. For example, by using FFT for each coating portion, it is possible to check whether or not each coating portion substantially contains crystals, and also it is possible to determine a relative crystal content ratio in each coating portion.

(Composition of Particle 1)

No particular limitation is imposed on the composition of the particle 1 except that it contains Fe. When the particle 1 contains Fe, it makes it easy for the first coating portion 13*a* and the second coating portion 13*b* to include oxides containing Fe. Further, when the particle 1 contains Fe and B, it makes it easy to control the crystallinity of the first coating portion and the second coating portion. Still further, when the particle 1 contains Si, it makes it easy to enhance the soft magnetic properties of the soft magnetic metal powder. Specifically, the soft magnetic metal powder tends to become soft magnetic metal powder having low Hcj and high Bs.

When the soft magnetic metal portion 11 has a Fe-based nanocrystal structure, the particle 1 may have, for example, a main component represented by a composition formula $(Fe_{(1-(\alpha+\beta))}X1_{\alpha}X2_{\beta})_{(1-(a+b+c+d+e+f))}M_aB_bP_cSi_dC_eS_f$, where X1 is one or more selected from the group consisting of Co and Ni, X2 is one or more selected from the group consisting of Al, Mn, Ag, Zn, Sn, As, Sb, Cu, Cr, Bi, N, O, and a rare earth element, M is one or more selected from the group consisting of Nb, Hf, Zr, Ta, Mo, W, Ti and V, and the following inequalities may be satisfied:

$0.0 \le a \le 0.140$,
$0.0 \le b \le 0.20$,
$0.0 \le c \le 0.20$,
$0 \le d \le 0.14$,
$0 \le e \le 0.20$,
$0 \le f \le 0.02$,
$0.7 \le 1-(a+b+c+d+e+f) \le 0.93$,
$\alpha \ge 0$,
$\beta \ge 0$, and
$0 \le \alpha+\beta 0.50$.

When the soft magnetic metal powder having the above composition is subjected to a heat treatment, Fe-based nanocrystals are easily deposited in the soft magnetic metal portion 11. In other words, the soft magnetic metal powder having the above composition is easily made as a starting material for soft magnetic alloy powder having particles 1 each including the soft magnetic metal portion 11 in which the Fe-based nanocrystals are deposited. Since the existence ratio of the first coating portion 13*a* and the second coating portion 13*b* occupying the entire particle 1 are small, the composition of the particle 1 and the composition of the soft magnetic metal portion 11 are almost coincidence with each other.

When the Fe-based nanocrystals are deposited in the soft magnetic metal portion 11 by the heat treatment, the soft magnetic metal portion 11 before the heat treatment may have a structure including only amorphous material, or may have a nano-heterostructure in which initial fine crystals exist in amorphous material. Note that the initial fine crystals may have an average grain size ranging from 0.3 nm or more to 10 nm or less. When the soft magnetic metal portion 11 has the structure including only amorphous material or the nano-heterostructure, the above-mentioned amorphization ratio X is 85% or more.

(Composition of Coating Portion 13)

The composition of the coating portion 13 is arbitrary. The coating portion 13 may contain B. This is because oxides containing B as a main component are easily contained in the first coating portion 13*a* and the second coating portion 13*b*. Further, when the average value of the concentration of B in the soft magnetic metal portion 11 is represented by $B_A$, and the average value of the concentration of B in the first coating portion 13*a* and the second coating portion 13*b* is represented by $B_B$, $0.5 \le B_B/B_A \le 10$ may be satisfied, and $1.0 \le B_B/B_A \le 5.5$ is preferably satisfied. When $B_B/B_A$ is within the above range, the powder resistivity tends to be enhanced.

When the coating portion 13 has the third coating portion, it is preferable that $1.0 \le B_B/B_A \le 3.0$ is satisfied. By satisfying $1.0 \le B_B/B_A \le 3.0$, wettability of the third coating portion is enhanced, and the powder resistivity of the soft magnetic metal powder is increased.

Note that no particular limitation is imposed on a method of measuring $B_A$ and $B_B$. For example, $B_A$ and $B_B$ can be measured by using EDX. $B_A$ is calculated, for example, by measuring and averaging the concentration of B for at least 20 points of the soft magnetic metal portion 11. When the concentration of B in the soft magnetic metal portion 11 is measured, the concentration of B is measured for a portion which is located at a distance of 10 nm or more from the coating portion 13.

$B_B$ is measured by the following method, for example. First, the concentration of B is measured and averaged for at least 20 points of the first coating portion 13*a* to calculate an average value ($B_{Ba}$) of the concentration of B in the first coating portion 13*a*. Next, the concentration of B is measured and averaged for at least 20 points of the second coating portion 13*b* to calculate an average value ($B_{Bb}$) of the concentration of B in the second coating portion 13*b*. Here, by setting $D_1+D_2=D$, $B_B$ is calculated from $B_B=(B_{Ba}\times D_1/D)+(B_{Bb}\times D_2/D)$.

The coating portion 13 may contain Si. This is because oxides containing Si are easily contained as a main component in the first coating portion 13*a* and the second coating portion 13*b*. Further, when the average value of the concentration of Si in the soft magnetic metal portion 11 is represented by $Si_A$ and the average value of the concentration of Si in the first coating portion 13*a* and the second coating portion 13*b* is represented by $Si_B$, $0.5\leq Si_B/Si_A\leq 50$ may be satisfied, and it is preferable that $0.8\leq Si_B/Si_A\leq 19.2$ is satisfied. When $Si_B/Si_A$ is within the above range, the powder resistivity tends to be enhanced.

Note that no particular limitation is imposed on a method of measuring $Si_A$ and $Si_B$. $Si_A$ and $Si_B$ may be measured in the same method as the above-described measurement method for $B_A$ and $B_B$.

The powder resistivity can be further enhanced by satisfying both of $1.0\leq B_B/B_A\leq 5.5$ and $0.8\leq Si_B/Si_A\leq 19.2$.

(Method of Manufacturing Soft Magnetic Metal Powder)

A method of manufacturing the soft magnetic metal powder according to the present embodiment will be described below, but the method of manufacturing the soft magnetic metal powder is not limited to the following method.

The soft magnetic metal powder according to the present embodiment can be manufactured, for example, by a gas atomization method. Particularly, when the soft magnetic metal powder is manufactured by the gas atomization method using a metal powder manufacturing apparatus 100 shown in FIG. 4, the obtained soft magnetic metal powder includes particles 1 each having the first coating portion 13*a* and the second coating portion 13*b* described above.

Figure 4:
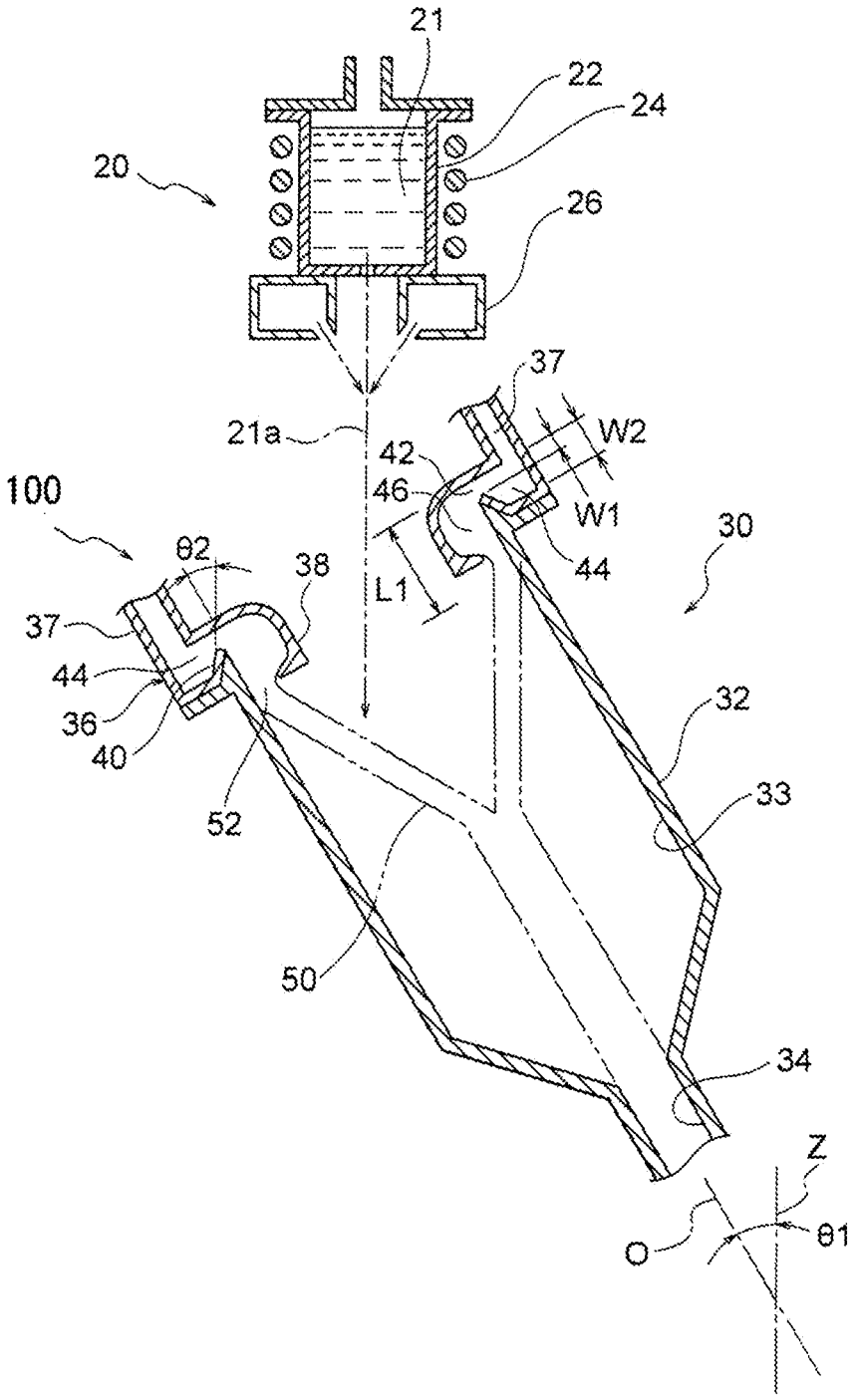
FIG. 4 is a schematic diagram of a metal powder manufacturing apparatus.

The metal powder manufacturing apparatus 100 shown in FIG. 4 is an apparatus for pulverizing molten metal 21 by the gas atomization method to obtain the particles 1 described above. The metal powder manufacturing apparatus 100 includes a molten metal supply unit 20 and a cooling unit 30 disposed below the molten metal supply unit 20 in a vertical direction. The vertical direction in FIG. 4 is a direction along the Z axis.

The molten metal supply unit 20 includes a heat-resistant container 22 for accommodating molten metal 21 therein. A heating coil 24 is arranged on the outer periphery of the heat-resistant container 22 to heat the molten metal 21 accommodated in the container 22 and maintain the molten metal 21 in a molten state. A discharge port is formed at the bottom of the container 22, and the molten metal 21 is discharged as dropped molten metal 21*a* through the discharge port to an inner surface 33 of a cylindrical body 32 constituting the cooling unit 30.

A gas injection nozzle 26 is arranged at an outside portion of an outer bottom wall of the container 22 so as to surround the discharge port. The gas injection nozzle 26 includes a gas injection port. A high-pressure gas (for example, a gas having an injection pressure of 3 MPa or more and 10 MPa or less) is injected from the gas injection port to the dropped molten metal 21*a* discharged from the discharge port. The high-pressure gas is injected obliquely downward from the entire circumference of the molten metal discharged from the discharge port 23, whereby the dropped molten metal 21*a* becomes a large number of droplets, and flows along the gas flow to the inner surface of the cylindrical body 32.

The composition of the molten metal 21 is set to the same composition as the soft magnetic metal portion 11 of the particles 1 finally obtained. When the composition of the molten metal 21 is set to the above-described composition, the surfaces of the particles 1 are easily oxidized by coming into contact with oxygen in the atmosphere for a short time. As a result, the coating portions 13 are formed on the particles 1. In other words, the thickness of the coating portion 13 can be controlled by controlling the oxygen concentration in the atmosphere. As described above, the metal powder manufacturing apparatus 100 uses an inert gas as the gas to be injected from the gas injection port of the gas injection nozzle 26, so that even the molten metal 21 that is easily oxidized can be easily pulverized.

It is preferable that an inert gas such as nitrogen gas, argon gas, or helium gas, or a reducing gas such as ammonia decomposition gas is preferable as the gas injected from the gas injection port. Air may be used depending on the easiness of oxidation of the molten metal 21.

In the present embodiment, the center axis O of the cylindrical body 32 is inclined at a predetermined angle θ1 with respect to the vertical line Z. The predetermined angle θ1 is not particularly limited, but is preferably 0° to 45°. By setting the angle range as described above, the dropped molten metal 21*a* from the discharge port can be easily discharged to a coolant flow 50 which is formed in an inverted conical shape inside the cylindrical body 32.

The dropped molten metal 21*a* discharged to the inverted conical coolant flow 50 impacts against the coolant flow 50 to be further divided and made finer, and also is cooled and solidified to become solid-state soft magnetic metal powder. A discharge portion 34 is provided on a lower side along the center axis O of the cylindrical body 32 so that the soft magnetic metal powder contained in the coolant flow 50 can be discharged to the outside together with the coolant. The soft magnetic metal powder discharged together with the coolant is separated from the coolant and taken out in an external storage tank or the like. Note that no particular limitation is imposed on the coolant, but cooling water is used.

In the present embodiment, a coolant lead-in portion (coolant lead-out portion) 36 for leading the coolant into the inside of the cylindrical body 32 is provided to an upper portion of the cylindrical body 32 in the direction of the center axis O. Note that the coolant lead-in portion 36 can also be defined as a coolant lead-out portion from the viewpoint that the coolant is discharged from the upper portion of the cylindrical body 32 to the inside of the cylindrical body 32.

The coolant lead-in portion 36 includes at least a frame body 38, and also includes an external portion (outer space portion) 44 located at the outside in the radial direction of the cylindrical body 32 and an internal portion (inner space portion) 46 located at the inside in the radial direction of the cylindrical body 32 inside the coolant lead-in portion 36. The external portion 44 and the internal portion 46 are partitioned by a partition portion 40, and the external portion 44 and the internal portion 46 are made to intercommunicate with each other through a passage portion 42 which is formed above the partition portion 40 in the direction of the center axis O so that the coolant can flow therebetween. As shown in FIG. 4, at the external portion 44, the partition portion 40 is inclined at an angle of θ2 with respect to the center axis O. The angle θ2 is preferably in the range of 0° to 90°, and more preferably 0° to 45°. At the internal portion 46, the wall surface of the partition portion 40 is preferably flush with the inner surface 33 of the cylindrical body 32. However, the wall surface of the partition portion 40 is not necessarily flush with the inner surface 33 of the cylindrical body 32, and may be slightly inclined or have a step with respect to the inner surface 33 of the cylindrical body 32.

A single or a plurality of nozzles 37 are connected to the external portion 44 so that the coolant is taken into the external portion 44 from the nozzle(s) 37. Further, a coolant discharge portion 52 is formed below the internal portion 46 in the direction of the center axis O, and the coolant in the internal portion 46 is discharged (led out) therefrom to the inside of the cylindrical body 32.

In the present embodiment, the frame body 38 of the coolant lead-in portion 36 is arranged at the upper portion of the cylindrical body 32 in the direction of the center axis O, and has a cylindrical shape having an outer diameter smaller than the inner diameter of the cylindrical body 32. The outer peripheral surface of the frame body 38 serves as a flow-path inner peripheral surface for guiding the flow of the coolant in the internal portion 46.

The external portion 44 and the internal portion 46 intercommunicate with each other by a passage portion 42 provided above the partition portion 40 in the direction of the center axis O. The passage portion 42 is a gap between an upper plate portion of the coolant lead-in portion 36 and an upper end of the partition portion 40, and the vertical width W1 in the direction of the center axis O of the passage portion 42 (see FIG. 4) is smaller than the vertical width W2 in the direction of the center axis O of the external portion 44. W1/W2 is preferably ⅓ or less, more preferably ¼ or less. By setting such a range, the inverted conical coolant flow 50 is easily formed by reflection of the coolant on the inner surface 33 of the cylindrical body 32 described later.

In the present embodiment, the nozzle 37 is connected to the external portion 44 of the coolant lead-in portion 36. By connecting the nozzle to the external portion 44 of the coolant lead-in portion 36, the coolant intrudes into the external portion 44 in the coolant lead-in portion 36 from the nozzle 37. The coolant that has intruded into the external portion 44 passes through the passage portion 42 and intrudes into the internal portion 46.

The frame body 38 has an inner diameter smaller than the inner surface 33 of the cylindrical body 32.

In the present embodiment, the coolant discharge portion 52 is formed in a gap between an outer convex portion at the lower end of the frame body 38 and the inner surface 33 of the cylindrical body 32. The width in the radial direction of the coolant discharge portion is larger than the vertical width W1 of the passage portion.

The inner diameter of the coolant discharge portion 52 is coincident with the maximum outer diameter of a flow path deflection surface, and the outer diameter of the coolant discharge portion 52 is substantially coincident with the inner diameter of the cylindrical body 32. Further, the outer diameter of the coolant discharge portion 52 may be made coincident with the inner surface 33 of the cylindrical body 32. Note that the inner diameter of the inner surface 33 of the cylindrical body 32 is not particularly limited, but is preferably 50 to 500 mm.

In the present embodiment, the coolant that is temporarily stored in the external portion 44 from the nozzle 37, and passes through the passage portion 42, and then intrudes into the internal portion 46 forms a flow directing downward in the direction of the center axis O along the flow-path inner peripheral surface of the frame body 38. The coolant flowing downward in the direction of the center axis O along the flow-path inner peripheral surface inside the internal portion 46 subsequently flows along the flow path deflection surface of the frame body 38, and impacts with and reflects from the inner surface 33 of the cylindrical body 32. As a result, as shown in FIG. 4, the coolant is discharged in an inverted conical shape from the coolant discharge portion 52 into the cylindrical body 32, thereby forming a coolant flow 50.

The coolant flow 50 flowing out of the coolant discharge portion 52 is an inverted conical flow that travels straightly from the coolant discharge portion 52 to the center axis O, but it may be a spiral inverted conical flow.

As shown in FIG. 4, the length L1 in the axial direction of the frame body 38 may be set to the extent that it covers the width W1 of the passage portion 42 in the direction of the center axis O.

In the present embodiment, the coolant that has intruded from the nozzle 37 into the external portion 44 is temporarily stored in the external portion 44, and then passes therefrom through the passage 42 to increase the flow rate thereof, and intrudes into the internal portion 46. In the internal portion 46, the coolant that has passed through the passage 42 impacts against a curvature surface formed on the inner peripheral surface of the flow path of the frame body 38, and the direction of the coolant flow is changed to a downward flow along the center axis O.

Next, the flow rate of the coolant flowing downward along the center axis O in the internal portion 46 increases because the cross section of the flow path is narrowed. The coolant impacts against and reflects from the inner surface of the cylindrical body 32 in a state where the flow rate is increased, and discharged from the coolant discharge portion 52 into the cylindrical body 32 in an inverted conical shape as shown in FIG. 4, thereby forming the coolant flow 50. Droplets of the dropped molten metal 21*a* shown in FIG. 4 are incident to the upper liquid surface of the inverted conical coolant flow 50 formed as described above, and the droplets of the dropped molten metal 21*a* flows together with the coolant and is cooled in the coolant flow 50.

In the method of manufacturing the soft magnetic metal powder using the metal powder manufacturing apparatus 100 according to the present embodiment, an inlet for droplets of the dropped molten metal 21*a* is formed at the upper opening portion of the cylindrical body 32, and a coolant flow 50 having an inverted conical shape is formed at the upper opening portion of the cylindrical body 32. The coolant flow 50 having the inverted conical shape has been formed at the upper opening portion of the cylindrical body 32, and the coolant is discharged from the discharge portion 34 of the cylindrical body 32, whereby a suction pressure into the inside of the cylindrical body 32 is obtained at the upper opening portion of the cylindrical body 32. For example, the suction pressure having a pressure difference of 30 kPa or more from the outside of the cylindrical body 32 is obtained.

Therefore, the droplets of the dropped molten metal 21*a* are sucked into the inside of the cylindrical body 32 from the upper opening portion of the cylindrical body 32 in a self-alignment manner (the droplets are automatically sucked even if they are slightly displaced), and taken into the inverted conical coolant flow 50. Therefore, the flight time of the droplets of the dropped molten metal 21*a* from the discharge port of the molten metal supply unit 20 to the coolant flow 50 is relatively shortened. As the flight time is shortened, the droplets of the dropped molten metal 21*a* are more difficult to be oxidized. Further, a quenching effect is promoted, and the soft magnetic metal portion 11 is likely to have an amorphous structure.

Further, in the present embodiment, the droplets of the dropped molten metal 21*a* are taken into, not the flow of the coolant along the inner surface 33 of the cylindrical body 32, but the flow of the inverted conical coolant, so that the retention time of the cooled particles 1 can be shortened in the cylindrical body 32, and the damage to the inner surface 33 of the cylindrical body 32 is also small. Further, the damage to the cooled particles themselves is also small.

Further, in the present embodiment, there is no need to machine the inner surface 33 of the cylindrical body 32, and there is no need to attach anything. Only by attaching the coolant lead-out portion 36 to the upper portion of the cylindrical body 32, the inverted conical coolant flow 50 can be formed. Further, the inner diameter of the upper opening portion of the cylindrical body 32 can be made sufficiently large.

When the metal powder manufacturing apparatus 100 shown in FIG. 4 is used, the cooling rate of the powder 1 can be increased as compared with a case where a conventional metal powder manufacturing apparatus is used. Here, a water pressure at the time when the coolant is jetted from the coolant discharge portion 52 is referred to as "atomization water pressure". As the atomization water pressure is higher, the flow rate of the coolant flow 50 increases, and the coolant flow 50 becomes thinner. As the flow rate of the coolant flow 50 increases, the cooling rate of the particles 1 further increases. Also, as the coolant flow 50 is thinner, a time during which the particles 1 are exposed to oxygen in the atmosphere is longer.

When the metal powder manufacturing apparatus 100 shown in FIG. 4 is used and the atomization water pressure is further increased, the surfaces of the particles 1 are exposed to oxygen in the atmosphere to form the coating portions 13 containing iron oxide components. By cooling the particles 1 at a higher cooling rate and increasing the time of the exposure to oxygen in the atmosphere as compared with the related art, the coating portion 13 can have the first coating portion 13*a* and the second coating portion 13*b* which are different in the microstructure from each other. On the other hand, when the conventional metal powder manufacturing apparatus is used or when the atomization water pressure is too low, it is difficult for the coating portion 13 to have the first coating portion 13*a* and the second coating portion 13*b*. In other words, it is difficult to obtain the soft magnetic metal powder according to the present embodiment.

A heat treatment may be conducted on the soft magnetic metal powder according to the present embodiment obtained by using the metal powder manufacturing apparatus 100. No particular limitation is imposed on the condition for the heat treatment. For example, the heat treatment may be conducted at 400° C. to 700° C. for 0.1 to 10 hours. By conducting the heat treatment, the iron oxide component of the coating portion 13 is reduced, and some of crystals of the second coating portion 13*b* are easily amorphized, so that the second coating portion 13*b* easily has a microstructure including both of crystals and amorphous material. Further, by conducting the heat treatment, the microstructure in the soft magnetic metal powder is easily changed to a structure having nanocrystals from the structure having only the amorphous material or the nano-heterostructure in which the initial fine crystals exist in the amorphous material. Hcj of the soft magnetic metal powder tends to decrease. Note that when the temperature of the heat treatment is too high, Hcj of the soft magnetic metal powder tends to increase.

Figure 5A:
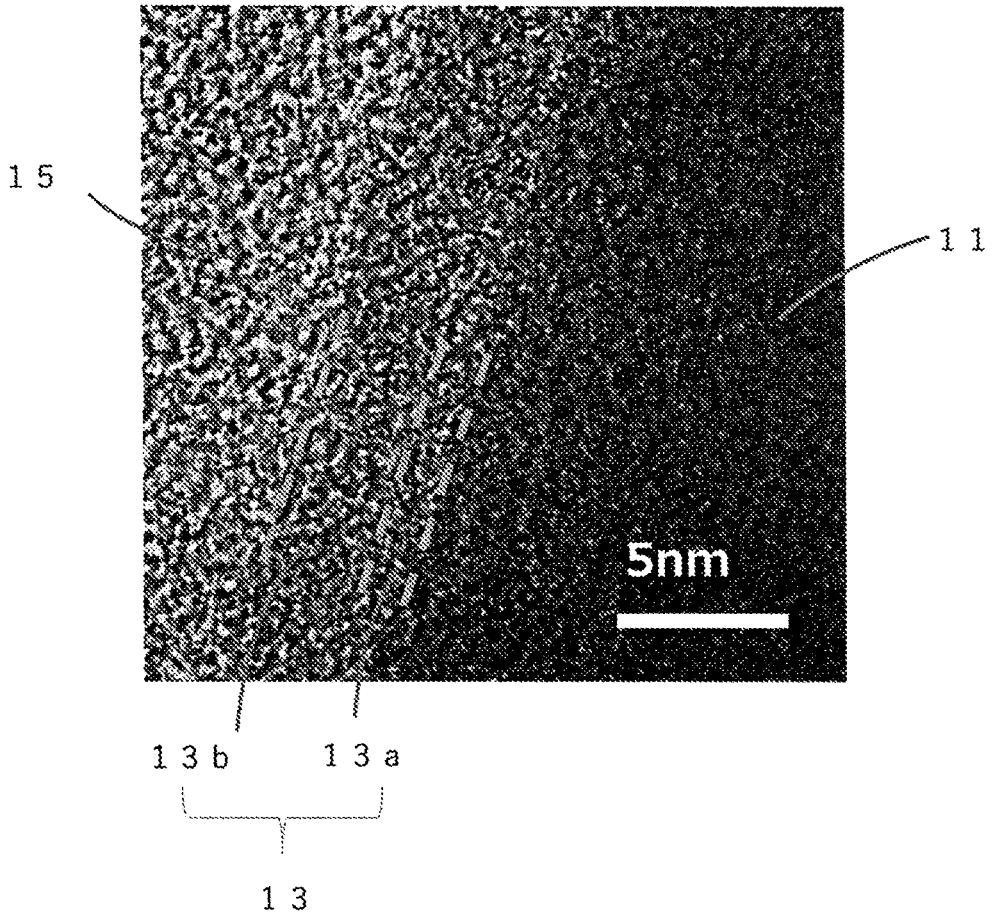
FIG. 5A is a transmission electron microscopy (TEM) image of a particle before a heat treatment.
Figure 5B:
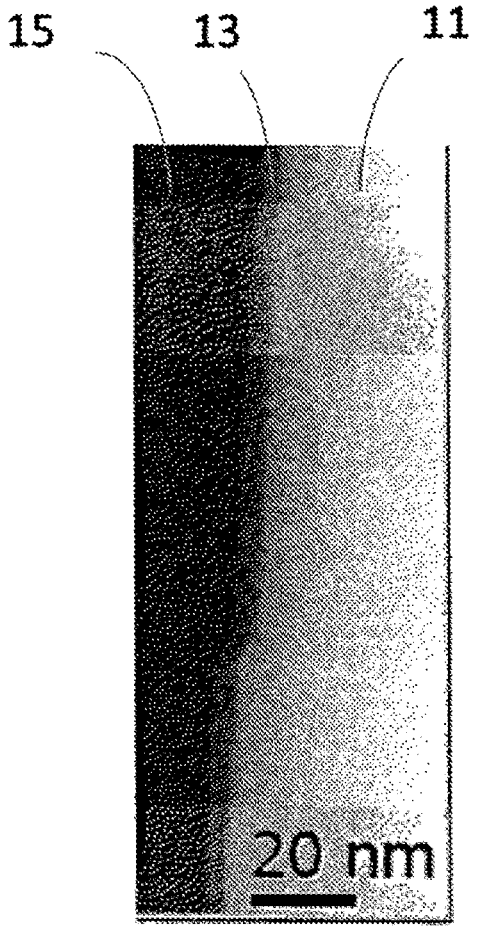
FIG. 5B is a high angle annular dark field scanning transmission electron microscopy (HAADF-STEM) image of a particle before the heat treatment.
Figure 5C:
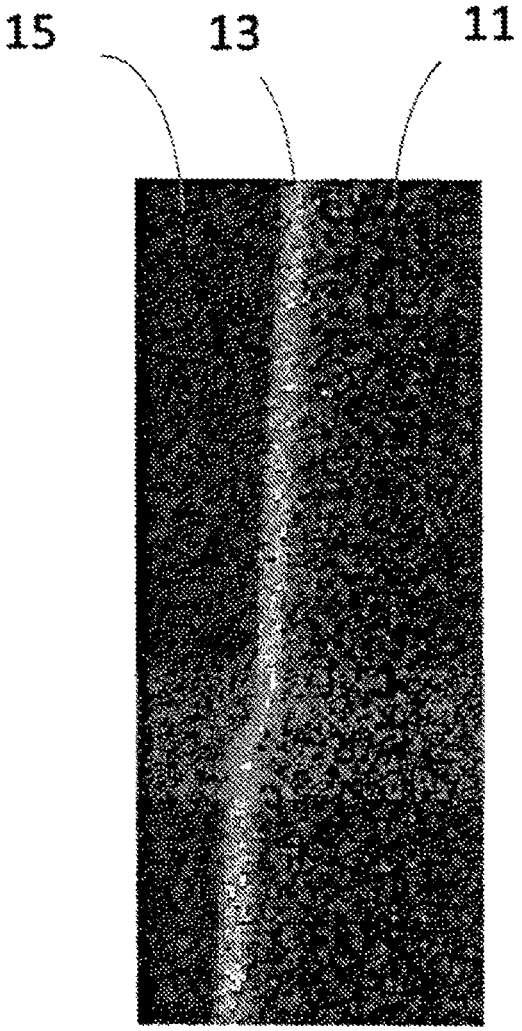
FIG. 5C is an O-mapping image of a particle before the heat treatment.
Figure 5D:
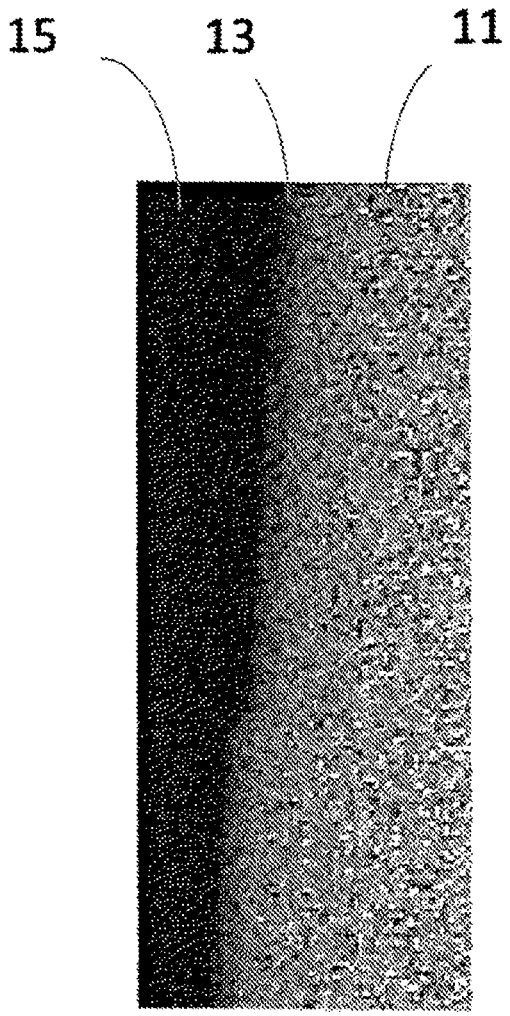
FIG. 5D is an Si-mapping image of a particle before a heat treatment.
Figure 5E:
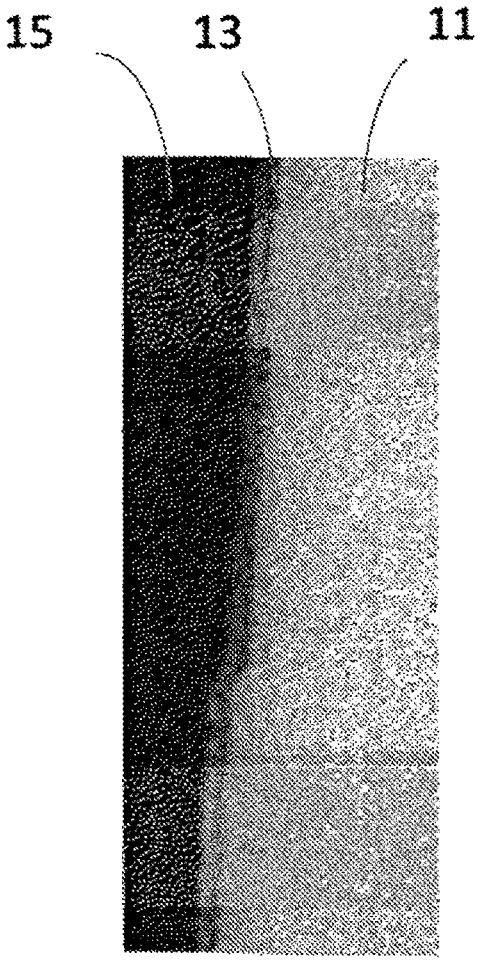
FIG. 5E is an Fe-mapping image of a particle before the heat treatment.
Figure 5F:
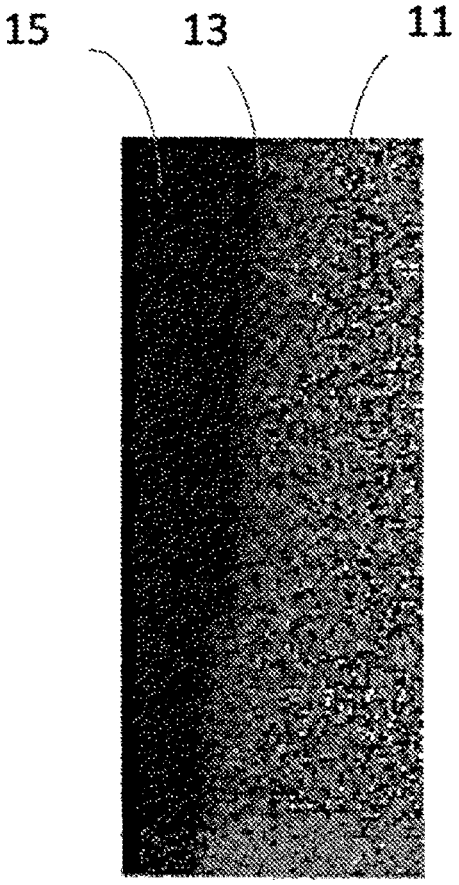
FIG. 5F is a B-mapping image of a particle before the heat treatment.

FIGS. 5A to 5F show examples of the particles 1 contained in the soft magnetic metal powder before the heat treatment. FIG. 5A shows a TEM image near the surface of particle 1, FIG. 5B shows an HAADF-STEM image near the surface of particle 1, FIG. 5C shows an O-mapping image near the surface of particle 1 by EELS, FIG. 5D shows an Si-mapping image near the surface of the particle 1 by EELS, FIG. 5E shows an Fe-mapping image near the surface of the particle 1 by EELS, and FIG. 5F shows a B-mapping image near the surface of the particle 1 by EELS. FIGS. 5A to 5F show images obtained by mixing the soft magnetic metal powder according to the present embodiment with resin 15 and producing a dust core by a well-known method, and observing cross-sections of the dust core. The first coating portion 13*a* and the second coating portion 13*b* in FIG. 5A were distinguished from each other by FFT. Further, the first coating portion 13*a* in FIG. 5A includes only amorphous material, and the second coating portion 13*b* includes only crystals.

Figure 6A:
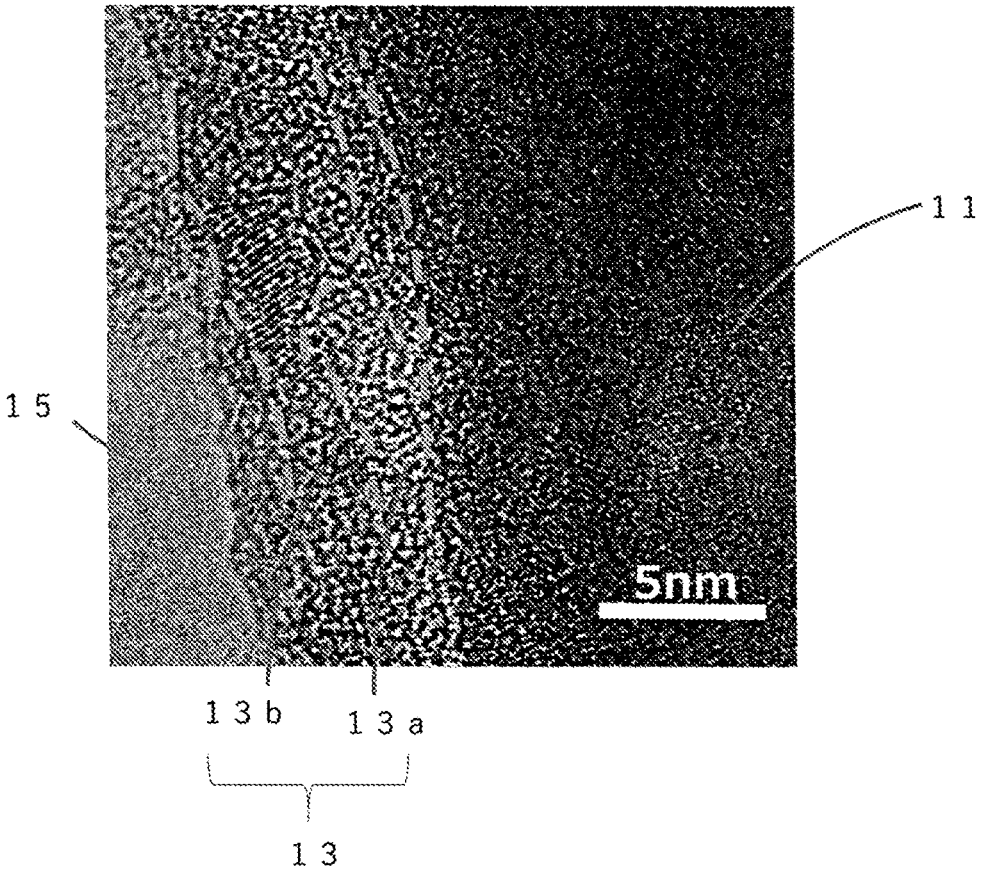
FIG. 6A is a TEM image of a particle after heat treatment.
Figure 6B:
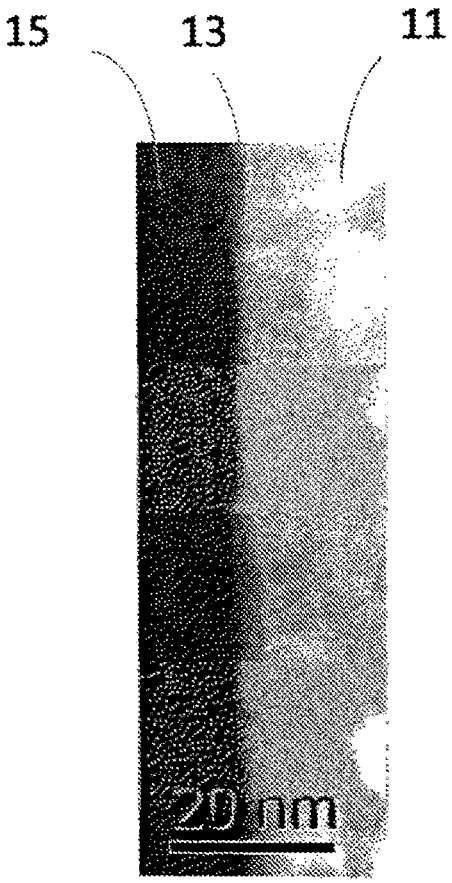
FIG. 6B is an HAADF-STEM image of a particle after the heat treatment.
Figure 6C:
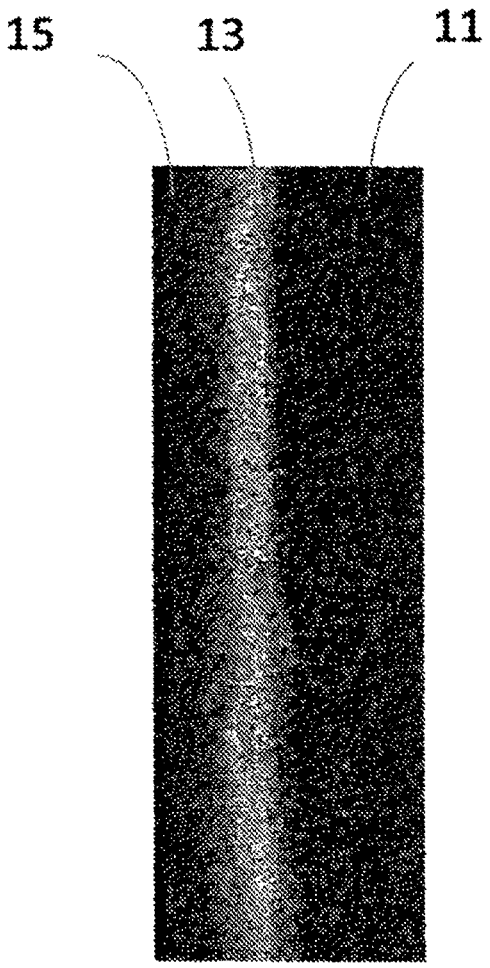
FIG. 6C is an O-mapping image of a particle after the heat treatment.
Figure 6D:
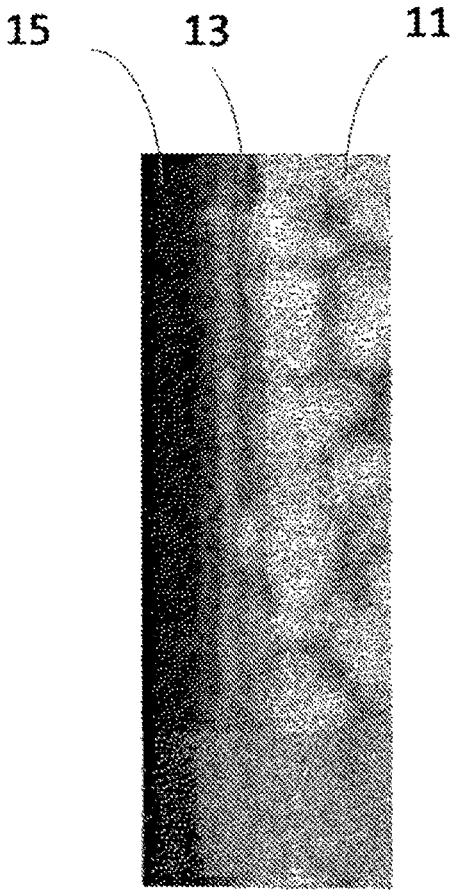
FIG. 6D is an Si-mapping image of a particle after the heat treatment.
Figure 6E:
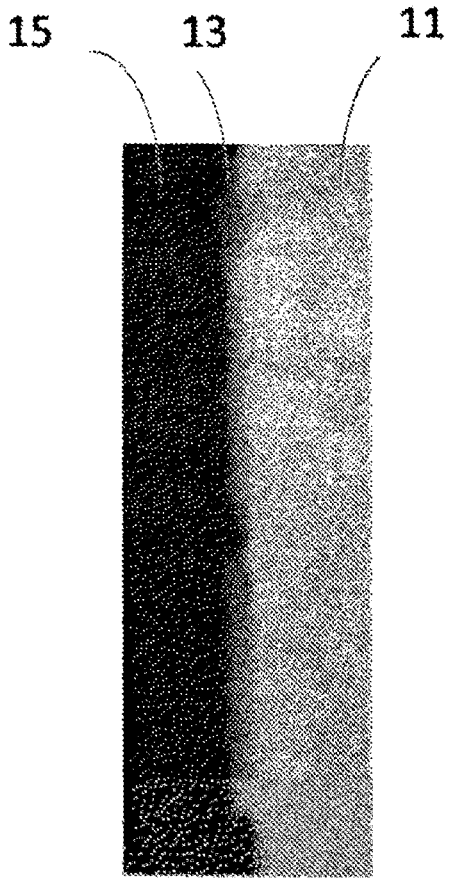
FIG. 6E is an Fe-mapping image of a particle after the heat treatment.
Figure 6F:
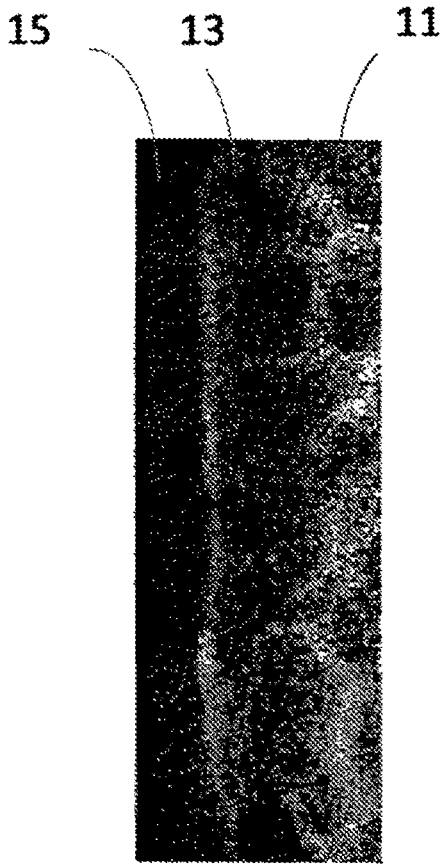
FIG. 6F is a B-mapping image of a particle after the heat treatment.

Further, FIGS. 6A to 6F show examples of the particles 1 contained in the soft magnetic metal powder after the heat treatment. Note that the soft magnetic metal powder containing the particles 1 shown in FIGS. 6A to 6F is obtained by conducting the heat treatment on the soft magnetic metal powder containing the particles 1 shown in FIGS. 5A to 5F. FIG. 6A shows a TEM image near the surface of the particle 1, FIG. 6B shows a HAADF-STEM image near the surface of particle 1, FIG. 6C shows an O-mapping image near the surface of particle 1 by EELS, FIG. 6D shows an Si-mapping image near the surface of the particle 1 by EELS, FIG. 6E shows an Fe-mapping image near the surface of the particle 1 by EELS, and FIG. 6F shows a B-mapping image near the surface of the particle 1 by EELS. FIGS. 6A to 6F show images obtained by mixing the soft magnetic metal powder according to the present embodiment with resin 15 and preparing a dust core by a well-known method, and observing cross-sections of the dust core. Further, the first coating portion 13*a* and the second coating portion 13*b* in FIG. 6A were distinguished from each other by FFT. Further, the first coating portion 13*a* in FIG. 6A is composed of only amorphous material, and the second coating portion 13*b* is composed of both of amorphous material and crystals.

By comparing FIGS. 5A to 5F with FIGS. 6A to 6F, it can be understood that Fe in the coating portion 13 is reduced by the heat treatment. Due to the reduction of Fe, particularly the crystallinity of the second coating portion 13*b* is deteriorated, and thus some of the crystals before the heat treatment are amorphized. Further, the second coating portion 13*b* has a microstructure including both of amorphous material and crystals. Note that FIGS. 5A to 5F show a sample number 1 described later, and FIGS. 6A to 6F show a sample number 6 described later.

Further, the third coating portion may be formed in the particle 1. No particular limitation is imposed on a method of forming the third coating portion. The third coating portion may be formed by using an insulating coating commonly used in the art.

No particular limitation is imposed on the type of coating material to be used for the insulating coating. For example, $P_2O_5$-based glass, $Bi_2O_3$-based glass, and $B_2O_3$—$SiO_2$-based glass may be used. Further, the glass to be used as the coating material may be powdered glass.

$P_2O_5$-based glass is preferably glass containing $P_2O_5$ of 50 mass % or more. No particular limitation is imposed on the type of $P_2O_5$-based glass. For example, $P_2O_5$—ZnO—$R_2O$—$Al_2O_3$-based glass may be used. Note that "R" represents alkali metal.

Glass containing $Bi_2O_3$ of 50 mass % or more is preferably used as $Bi_2O_3$-based glass. No particular limitation is imposed on the type of $Bi_2O_3$-based glass. For example, bismuthate-based glass may be used. Examples of the bismuthate-based glass include $Bi_2O_3$—ZnO—$B_2O_3$—$SiO_2$-based glass.

Glass containing $B_2O_3$ of 10 mass % or more and $SiO_2$ of 10 mass % or more is preferably used as $B_2O_3$—$SiO_2$-based glass. No particular limitation is imposed on the type of $B_2O_3$—$SiO_2$-based glass. For example, borosilicate glass may be used. Examples of the borosilicate glass include BaO—ZnO—$B_2O_3$—$SiO_2$—$Al_2O_3$-based glass.

The soft magnetic metal powder according to the present embodiment has been described above, but the soft magnetic metal powder according to the present invention is not limited to the above-described embodiment.

No particular limitation is imposed on the use of the soft magnetic metal powder of the present invention. For example, magnetic components such as an inductor, a choke coil, and a transformer may be used.

EXAMPLES

Hereinafter, the present invention will be described based on more detailed examples, but the present invention is not limited to these examples.

Experimental Example 1

Soft magnetic metal powder including the following composition 1 or composition 2 was produced as the soft magnetic metal powder. The composition 1 is represented by $Fe_{0.735}Nb_{0.03}B_{0.09}Si_{0.135}Cu_{0.01}$ in atomic ratio. The composition 2 is represented by $Fe_{0.800}Nb_{0.060}B_{0.090}P_{0.050}$ in atomic ratio.

The soft magnetic metal powder was produced by a gas atomization method using the metal powder manufacturing apparatus 100 shown in FIG. 4. The melting temperature was set to 1500° C., the injection gas pressure of the molten metal was set to 5 MPa, and the gas used was Ar. The gas atomization water pressure is shown in Table 1. In the metal powder manufacturing apparatus 100, the inner diameter of the inner surface of the cylindrical body 32 was set to 300 nm, W1/W2 was set to 0.25, θ1 was set to 20°, and θ2 was set to 0°. Conditions other than the above condition were appropriately controlled so that the average grain size (D50) of the obtained soft magnetic metal powder was 24 μm.

In some experimental examples, the heat treatment was conducted on the soft magnetic metal powder. When the heat treatment was conducted, the heat treatment was conducted at 600° C. for 1 hour. The atmosphere under the heat treatment was an Ar atmosphere.

The average grain size (D50) of the obtained soft magnetic metal powder was measured, and it was confirmed that all the measured average grain sizes were equal to 24 μm. The average particle size was measured by using a dry type particle size distribution measurement instrument (HELOS).

Next, Hcj, Bs and powder resistivity ρ of the soft magnetic metal powder of each of the examples and comparative examples were measured. Hcj was measured by an Hc meter. Bs was measured at 1000 kA/m by using a vibrating sample magnetometer (VSM), and ρ was measured at a pressure of 0.6 t/cm$^2$ by a powder resistance measurement device. In this experimental example, a case where ρ was equal to $10^2$ Ωcm or more was evaluated as A, a case where ρ was $10^{-1}$ Ωcm or more and less than $10^2$ Ωcm was evaluated as B, and a case where ρ was less than $10^{-1}$ Ωcm was evaluated as C, and a measurement result is shown in Table 1. When the evaluation was A or B, the powder resistivity was determined to be good, and when the evaluation was A, the powder resistivity was determined to be particularly good.

Next, the coating portions included in the soft magnetic metal powders of the respective examples and comparative examples were observed. First, a bright field image near the particle surface was observed by using TEM, and it was confirmed that the coating portion existed on the particle surface. Next, a mapping image for each element was observed by using EELS, and it was observed whether or not the coating portion included the first coating portion and the second coating portion. It was confirmed that the coating portions of sample numbers 1 to 10 contained an oxide of Fe, an oxide of B, and an oxide of Si. It was confirmed that the coating portions of sample numbers 11 to 20 contained an oxide of Fe and an oxide of B.

It was confirmed whether or not each coating portion included crystals and amorphous material by using FFT. A result is shown in Table 1. When each coating portion included only amorphous material, "amorphous" was written in the column of crystallinity. When each coating portion included only crystals, "crystal" was written in the column of crystallinity. When each coating portion included crystals and amorphous material, "crystal+amorphous" was written in the column of crystallinity.

Note that in the case where the coating portion is not composed of the first coating portion and the second coating portion, in Table 1, the coating portion is described to be included only the second coating portion when the entire coating portion includes crystals substantially uniformly, and the coating portion is described to be included only the first coating portion when the entire coating portion includes only amorphous material.

The average thicknesses $D_1$ and $D_2$ of the respective coating portions were calculated by determining the boundary between the first coating portion and the second coating portion by using TEM, FFT, and EELS. A result is shown in Table 1.

$B_A$, $B_B$, $Si_A$, and $Si_B$ were calculated by measuring the concentration of B and the concentration of Si of each of the first coating portion and the second coating portion by using EDX in addition to the above-described equipment. Further, $B_B/B_A$ and $Si_B/Si_A$ were calculated. Results are shown in Table 1. Note that $Si_A$ and $Si_B$ were not measured for sample numbers 11 to 20 containing no Si.

TABLE 1

| SAMPLE No. | EXAMPLE/ COMPARATIVE EXAMPLE | COMPOSITION | ATOMIZATION WATER PRESSURE (MPa) | HEAT TREATMENT | Hcj (Oe) | Bs (A · m²/kg) | ρ | FIRST COATING PORTION MICRO-STRUCTURE | B (at %) | Si (at %) | $D_1$ (nm) | SECOND COATING PORTION MICRO-STRUCTURE | B (at %) | Si (at %) | $D_2$ (nm) | $D_2/D_1$ | $B_B/B_A$ | $Si_B/Si_A$ |
|---|---|---|---|---|---|---|---|---|---|---|---|---|---|---|---|---|---|---|
| 1 | EXAMPLE | COMPOSITION 1 | 10 | NOT CONDUCTED | 1.1 | 133 | A | AMORPHOUS | 11.7 | 15.4 | 2 | CRYSTAL | 12.5 | 12.7 | 4 | 2.0 | 1.3 | 1.1 |
| 2 | EXAMPLE | COMPOSITION 1 | 9 | NOT CONDUCTED | 1.2 | 129 | A | AMORPHOUS | 10.8 | 12.8 | 3 | CRYSTAL | 11.0 | 7.7 | 4 | 1.3 | 1.3 | 0.8 |
| 3 | EXAMPLE | COMPOSITION 1 | 7 | NOT CONDUCTED | 1.2 | 140 | B | AMORPHOUS | 5.7 | 7.8 | 2 | CRYSTAL | 2.5 | 4.9 | 3 | 1.5 | 0.4 | 0.5 |
| 4 | COMPARATIVE EXAMPLE | COMPOSITION 1 | 5 | NOT CONDUCTED | 1.1 | 132 | C | AMORPHOUS | 4.5 | 8.0 | 5 | | NO | | | — | 0.5 | 0.6 |
| 5 | COMPARATIVE EXAMPLE | COMPOSITION 1 | 1 | NOT CONDUCTED | 1.2 | 127 | C | AMORPHOUS | 5.6 | 6.6 | 6 | | NO | | | — | 0.6 | 0.5 |
| 6 | EXAMPLE | COMPOSITION 1 | 10 | CONDUCTED | 1.0 | 143 | A | AMORPHOUS | 30.9 | 40.1 | 3 | CRYSTAL + AMORPHOUS | 35.6 | 28.8 | 3 | 1.0 | 3.7 | 2.4 |
| 7 | EXAMPLE | COMPOSITION 1 | 9 | CONDUCTED | 1.1 | 133 | A | AMORPHOUS | 28.5 | 13.7 | 4 | CRYSTAL + AMORPHOUS | 29.7 | 12.2 | 2 | 0.5 | 3.1 | 1.0 |
| 8 | EXAMPLE | COMPOSITION 1 | 7 | CONDUCTED | 1.0 | 130 | B | AMORPHOUS | 25.3 | 7.3 | 5 | CRYSTAL + AMORPHOUS | 26.3 | 4.7 | 2 | 0.4 | 2.8 | 0.5 |
| 9 | COMPARATIVE EXAMPLE | COMPOSITION 1 | 5 | CONDUCTED | 1.0 | 134 | C | AMORPHOUS | 14.7 | 15.2 | 6 | | NO | | | — | 1.6 | 1.1 |
| 10 | COMPARATIVE EXAMPLE | COMPOSITION 1 | 1 | CONDUCTED | 1.0 | 130 | C | AMORPHOUS | 16.9 | 11.1 | 6 | | NO | | | — | 1.8 | 0.8 |
| 11 | EXAMPLE | COMPOSITION 2 | 10 | NOT CONDUCTED | 2.6 | 170 | A | AMORPHOUS | 18.2 | — | 4 | CRYSTAL | 10.4 | — | 2 | 0.5 | 1.6 | — |
| 12 | EXAMPLE | COMPOSITION 2 | 9 | NOT CONDUCTED | 2.5 | 177 | A | AMORPHOUS | 9.8 | — | 4 | CRYSTAL | 7.0 | — | 3 | 0.8 | 1.0 | — |
| 13 | EXAMPLE | COMPOSITION 2 | 7 | NOT CONDUCTED | 2.3 | 174 | B | AMORPHOUS | 6.2 | — | 3 | CRYSTAL | 2.2 | — | 3 | 1.0 | 0.5 | — |
| 14 | COMPARATIVE EXAMPLE | COMPOSITION 2 | 5 | NOT CONDUCTED | 2.5 | 171 | C | | NO | | | CRYSTAL | 2.5 | — | 6 | — | 0.3 | — |

TABLE 1-continued

| SAMPLE No. | EXAMPLE/ COMPARATIVE EXAMPLE | COMPOSITION | ATOMIZATION WATER PRESSURE (MPa) | HEAT TREATMENT | Hcj (Oe) | Bs (A · m²/kg) | ρ | FIRST COATING PORTION MICRO-STRUCTURE | B (at %) | Si (at %) | $D_1$ (nm) | SECOND COATING PORTION MICRO-STRUCTURE | B (at %) | Si (at %) | $D_2$ (nm) | $D_2/D_1$ | $B_B/B_A$ | $Si_B/Si_A$ |
|---|---|---|---|---|---|---|---|---|---|---|---|---|---|---|---|---|---|---|
| 15 | COMPARATIVE EXAMPLE | COMPOSITION 2 | 1 | NOT CONDUCTED | 2.7 | 168 | C | | NO | | | CRYSTAL | 2.7 | — | 7 | — | 0.3 | — |
| 16 | EXAMPLE | COMPOSITION 2 | 10 | CONDUCTED | 2.4 | 173 | A | AMORPHOUS | 15.2 | — | 3 | CRYSTAL | 8.8 | — | 5 | 1.7 | 1.1 | — |
| 17 | EXAMPLE | COMPOSITION 2 | 9 | CONDUCTED | 2.2 | 169 | A | AMORPHOUS | 10.6 | — | 3 | CRYSTAL | 7.5 | — | 4 | 1.3 | 1.0 | — |
| 18 | EXAMPLE | COMPOSITION 2 | 7 | CONDUCTED | 2.3 | 168 | B | AMORPHOUS | 8.5 | — | 2 | CRYSTAL | 2.7 | — | 5 | 2.5 | 0.5 | — |
| 19 | COMPARATIVE EXAMPLE | COMPOSITION 2 | 5 | CONDUCTED | 2.4 | 170 | C | | NO | | | CRYSTAL | 4.5 | — | 7 | — | 0.5 | — |
| 20 | COMPARATIVE EXAMPLE | COMPOSITION 2 | 1 | CONDUCTED | 2.6 | 166 | C | | NO | | | CRYSTAL | 4.9 | — | 6 | — | 0.5 | — |

From Table 1, examples in which the atomization water pressure was high acquired soft magnetic metal powder in which the coating portion included the first coating portion and the second coating portion, and the first coating portion included particles each having a structure in which the first coating portion was closer to the soft magnetic metal portion than the second coating portion. Further, examples having the composition 1 acquired soft magnetic metal powder containing particles each having a structure in which the first coating portion and the second coating portion had oxides of Si, Fe and B as main components, the first coating portion included only amorphous material, and the second coating portion included crystals. Examples having the composition 2 acquired soft magnetic metal powder containing particles each having a structure in which the first coating portion and the second coating portion had oxides of Fe and B as main components, the first coating portion included only amorphous material, and the second coating portion included crystals. Each of the examples has excellent soft magnetic properties which are the same level as comparative examples having the same configuration as each example except that the entire coating portion included only amorphous material or included only crystals. Further, each of the examples has an excellent ρ as compared with comparative examples having the same configuration as each of the examples except that the entire coating portion included only amorphous material or included only crystals.

Experimental Example 2

Soft magnetic metal powder was produced and evaluated in the same manner as that in Experimental Example 1 except that the composition of the soft magnetic metal powder was changed to the composition shown in Table 2. Results are shown in Table 2. The atomization water pressure was set to 10 MPa for all the examples. All the evaluations of ρ were A evaluations. Furthermore, it was confirmed for samples containing Si and B that the coating portion contained oxides of Si, Fe, and B. For samples which did not contain Si, but contained B, it was confirmed that the coating portion contained oxides of Fe and B.

TABLE 2

| SAMPLE No. | Fe | M(Nb) a | B b | P c | Si d | C e | s f | HEAT TREATMENT | Hcj (Oe) | Bs (A · m²/kg) | FIRST COATING PORTION MICRO-STRUCTURE | B (at %) | Si (at %) | $D_1$ (nm) | SECOND COATING PORTION MICRO-STRUCTURE | B (at %) | Si (at %) | $D_2$ (nm) | $D_2/D_1$ | $B_B/B_A$ | $Si_B/Si_A$ |
|---|---|---|---|---|---|---|---|---|---|---|---|---|---|---|---|---|---|---|---|---|---|
| | $Fe_{(1-(a+b+c+d+e+f))}M_aB_bP_cSi_dC_eS_f$ (M is Nb) | | | | | | | | | | | | | | | | | | | | |
| 21 | 0.790 | 0.060 | 0.090 | 0.050 | 0.010 | 0.000 | 0.000 | NOT CONDUCTED | 2.9 | 165 | AMORPHOUS | 15.9 | 6.2 | 2 | CRYSTAL | 11.4 | 4.2 | 6 | 3.0 | 1.5 | 4.5 |
| 22 | 0.790 | 0.060 | 0.090 | 0.050 | 0.010 | 0.000 | 0.000 | CONDUCTED | 2.4 | 150 | AMORPHOUS | 26.9 | 12.3 | 2 | CRYSTAL + AMORPHOUS | 17.8 | 6.6 | 7 | 3.5 | 2.2 | 8.0 |
| 23 | 0.770 | 0.060 | 0.090 | 0.050 | 0.030 | 0.000 | 0.000 | NOT CONDUCTED | 3.6 | 160 | AMORPHOUS | 21.9 | 18.5 | 7 | CRYSTAL | 14.0 | 7.1 | 8 | 1.1 | 2.2 | 4.1 |
| 24 | 0.770 | 0.060 | 0.090 | 0.050 | 0.030 | 0.000 | 0.000 | CONDUCTED | 2.7 | 155 | AMORPHOUS | 33.0 | 37.8 | 2 | CRYSTAL + AMORPHOUS | 27.8 | 31.3 | 7 | 3.5 | 3.0 | 11.0 |
| 25 | 0.740 | 0.060 | 0.090 | 0.050 | 0.060 | 0.000 | 0.000 | NOT CONDUCTED | 4.8 | 150 | AMORPHOUS | 20.5 | 16.2 | 6 | CRYSTAL | 12.7 | 9.7 | 5 | 0.8 | 1.9 | 1.9 |
| 26 | 0.740 | 0.060 | 0.090 | 0.050 | 0.060 | 0.000 | 0.000 | CONDUCTED | 4.6 | 153 | AMORPHOUS | 29.7 | 25.4 | 3 | CRYSTAL + AMORPHOUS | 21.7 | 19.3 | 6 | 2.0 | 2.6 | 3.2 |
| 27 | 0.700 | 0.040 | 0.080 | 0.040 | 0.140 | 0.000 | 0.000 | NOT CONDUCTED | 2.8 | 128 | AMORPHOUS | 16.4 | 20.1 | 7 | CRYSTAL | 10.5 | 10.3 | 8 | 1.1 | 1.6 | 1.0 |
| 28 | 0.700 | 0.040 | 0.080 | 0.040 | 0.140 | 0.000 | 0.000 | CONDUCTED | 2.3 | 133 | AMORPHOUS | 27.2 | 39.2 | 3 | CRYSTAL + AMORPHOUS | 16.6 | 22.4 | 4 | 1.3 | 2.8 | 1.9 |
| 29 | 0.818 | 0.060 | 0.090 | 0.010 | 0.010 | 0.010 | 0.002 | NOT CONDUCTED | 4.0 | 178 | AMORPHOUS | 15.3 | 9.5 | 3 | CRYSTAL | 12.2 | 7.1 | 6 | 2.0 | 1.5 | 6.6 |
| 30 | 0.818 | 0.060 | 0.090 | 0.010 | 0.010 | 0.010 | 0.002 | CONDUCTED | 3.5 | 178 | AMORPHOUS | 25.7 | 23.3 | 2 | CRYSTAL + AMORPHOUS | 13.5 | 18.4 | 5 | 2.5 | 1.8 | 19.2 |
| 31 | 0.795 | 0.060 | 0.090 | 0.010 | 0.020 | 0.020 | 0.005 | NOT CONDUCTED | 3.3 | 174 | AMORPHOUS | 21.9 | 18.5 | 7 | CRYSTAL | 13.0 | 7.1 | 8 | 1.1 | 1.1 | 5.9 |
| 32 | 0.795 | 0.060 | 0.090 | 0.010 | 0.020 | 0.020 | 0.005 | CONDUCTED | 2.1 | 172 | AMORPHOUS | 38.7 | 33.2 | 2 | CRYSTAL + AMORPHOUS | 27.8 | 16.7 | 6 | 3.0 | 3.3 | 10.6 |
| 33 | 0.795 | 0.060 | 0.090 | 0.030 | 0.010 | 0.010 | 0.005 | NOT CONDUCTED | 3.1 | 166 | AMORPHOUS | 22.3 | 16.6 | 7 | CRYSTAL | 11.5 | 11.8 | 6 | 0.9 | 1.9 | 15.7 |
| 34 | 0.795 | 0.060 | 0.090 | 0.030 | 0.010 | 0.010 | 0.005 | CONDUCTED | 2.7 | 155 | AMORPHOUS | 34.4 | 28.6 | 3 | CRYSTAL + AMORPHOUS | 23.7 | 18.2 | 6 | 2.0 | 2.9 | 19.0 |
| 35 | 0.778 | 0.060 | 0.090 | 0.030 | 0.020 | 0.020 | 0.002 | NOT CONDUCTED | 3.0 | 163 | AMORPHOUS | 18.5 | 9.8 | 2 | CRYSTAL | 15.6 | 7.1 | 7 | 3.5 | 2.2 | 4.1 |
| 36 | 0.778 | 0.060 | 0.090 | 0.030 | 0.020 | 0.020 | 0.002 | CONDUCTED | 2.3 | 165 | AMORPHOUS | 26.7 | 35.6 | 1 | CRYSTAL + AMORPHOUS | 21.5 | 26.6 | 6 | 6.0 | 2.6 | 15.3 |
| 37 | 0.775 | 0.060 | 0.090 | 0.050 | 0.010 | 0.010 | 0.005 | NOT CONDUCTED | 2.9 | 160 | AMORPHOUS | 23.4 | 17.5 | 6 | CRYSTAL | 13.9 | 11.5 | 8 | 1.3 | 1.9 | 13.6 |
| 38 | 0.775 | 0.060 | 0.090 | 0.050 | 0.010 | 0.010 | 0.005 | CONDUCTED | 2.6 | 157 | AMORPHOUS | 31.1 | 39.3 | 2 | CRYSTAL + AMORPHOUS | 26.9 | 12.3 | 5 | 2.5 | 3.2 | 17.4 |
| 39 | 0.830 | 0.030 | 0.090 | 0.050 | 0.000 | 0.000 | 0.000 | NOT CONDUCTED | 3.3 | 179 | AMORPHOUS | 17.5 | — | 5 | CRYSTAL | 14.2 | — | 5 | 1.0 | 1.6 | — |
| 40 | 0.830 | 0.030 | 0.090 | 0.050 | 0.000 | 0.000 | 0.000 | CONDUCTED | 2.5 | 176 | AMORPHOUS | 33.5 | — | 3 | CRYSTAL + AMORPHOUS | 21.5 | — | 6 | 2.0 | 2.8 | — |
| 11 | 0.800 | 0.060 | 0.090 | 0.050 | 0.000 | 0.000 | 0.000 | NOT CONDUCTED | 2.6 | 170 | AMORPHOUS | 18.2 | — | 4 | CRYSTAL | 10.4 | — | 2 | 0.5 | 1.6 | — |
| 16 | 0.800 | 0.060 | 0.090 | 0.050 | 0.000 | 0.000 | 0.000 | CONDUCTED | 2.4 | 173 | AMORPHOUS | 15.2 | — | 3 | CRYSTAL | 8.8 | — | 5 | 1.7 | 1.1 | — |
| 41 | 0.760 | 0.100 | 0.090 | 0.050 | 0.000 | 0.000 | 0.000 | NOT CONDUCTED | 2.5 | 171 | AMORPHOUS | 11.4 | — | 6 | CRYSTAL | 4.4 | — | 3 | 0.5 | 1.0 | — |
| 42 | 0.760 | 0.100 | 0.090 | 0.050 | 0.000 | 0.000 | 0.000 | CONDUCTED | 1.9 | 163 | AMORPHOUS | 21.5 | — | 3 | CRYSTAL + AMORPHOUS | 13.4 | — | 4 | 1.3 | 1.9 | — |
| 43 | 0.720 | 0.140 | 0.090 | 0.050 | 0.000 | 0.000 | 0.000 | NOT CONDUCTED | 2.8 | 157 | AMORPHOUS | 18.3 | — | 5 | CRYSTAL | 12.6 | — | 2 | 0.4 | 1.8 | — |
| 44 | 0.720 | 0.140 | 0.090 | 0.050 | 0.000 | 0.000 | 0.000 | CONDUCTED | 2.5 | 151 | AMORPHOUS | 38.4 | — | 4 | CRYSTAL + AMORPHOUS | 24.2 | — | 3 | 0.8 | 3.7 | — |

TABLE 2-continued

| SAMPLE No. | $Fe_{(1-(a+b+c+d+e+f))}M_aB_bP_cSi_dC_eS_f$ (M is Nb) Fe | M(Nb) a | B b | P c | Si d | C e | s f | HEAT TREATMENT | Hcj (Oe) | Bs (A · m²/kg) | FIRST COATING PORTION MICRO-STRUCTURE | B (at %) | Si (at %) | $D_1$ (nm) | SECOND COATING PORTION MICRO-STRUCTURE | B (at %) | Si (at %) | $D_2$ (nm) | $D_2/D_1$ | $B_B/B_A$ | $Si_B/Si_A$ |
|---|---|---|---|---|---|---|---|---|---|---|---|---|---|---|---|---|---|---|---|---|---|
| 45 | 0.865 | 0.060 | 0.025 | 0.050 | 0.000 | 0.000 | 0.000 | NOT CONDUCTED | 3.2 | 187 | AMORPHOUS | 12.4 | — | 3 | CRYSTAL | 3.4 | — | 5 | 1.7 | 2.6 | — |
| 46 | 0.865 | 0.060 | 0.025 | 0.050 | 0.000 | 0.000 | 0.000 | CONDUCTED | 2.6 | 185 | AMORPHOUS | 18.8 | — | 4 | CRYSTAL + AMORPHOUS | 9.5 | — | 4 | 1.0 | 5.5 | — |
| 47 | 0.830 | 0.060 | 0.060 | 0.050 | 0.000 | 0.000 | 0.000 | NOT CONDUCTED | 2.3 | 175 | AMORPHOUS | 13.8 | — | 4 | CRYSTAL | 7.4 | — | 5 | 1.3 | 1.6 | — |
| 48 | 0.830 | 0.060 | 0.060 | 0.050 | 0.000 | 0.000 | 0.000 | CONDUCTED | 2.0 | 177 | AMORPHOUS | 21.9 | — | 3 | CRYSTAL + AMORPHOUS | 11.2 | — | 4 | 1.3 | 2.5 | — |
| 11 | 0.800 | 0.060 | 0.090 | 0.050 | 0.000 | 0.000 | 0.000 | NOT CONDUCTED | 2.6 | 170 | AMORPHOUS | 18.2 | — | 4 | CRYSTAL | 10.4 | — | 2 | 0.5 | 1.6 | — |
| 16 | 0.800 | 0.060 | 0.090 | 0.050 | 0.000 | 0.000 | 0.000 | CONDUCTED | 2.4 | 173 | AMORPHOUS | 15.2 | — | 3 | CRYSTAL | 8.8 | — | 5 | 1.7 | 1.1 | — |
| 51 | 0.750 | 0.060 | 0.140 | 0.050 | 0.000 | 0.000 | 0.000 | NOT CONDUCTED | 3.2 | 155 | AMORPHOUS | 16.1 | — | 3 | CRYSTAL | 15.6 | — | 4 | 1.3 | 1.1 | — |
| 52 | 0.750 | 0.060 | 0.140 | 0.050 | 0.000 | 0.000 | 0.000 | CONDUCTED | 2.5 | 153 | AMORPHOUS | 26.8 | — | 2 | CRYSTAL + AMORPHOUS | 10.9 | — | 4 | 2.0 | 1.2 | — |

From Table 2, the examples in which the atomization water pressure was high acquired soft magnetic metal powder containing particles each having a structure in which the coating portion included the first coating portion and the second coating portion, and the first coating portion was closer to the soft magnetic metal portion than the second coating portion. Further, the examples acquired soft magnetic metal powder containing particles each having a structure in which the first coating portion and the second coating portion had oxides including at least one element selected from Si, Fe and B as a main component, the first coating portion included only amorphous material, and the second coating portion included crystals.

Experimental Example 3

Soft magnetic metal powder was produced and evaluated in the same manner as that in the sample number 11 of Experimental Examples 1 and 2 except that the kind of M element was changed from Nb to other elements for the sample number 11 of Experimental Examples 1 and 2. Results are shown in Table 3. Note that all evaluations of ρ were A evaluations. Furthermore, it was confirmed that the coating portion included oxides containing Fe and B.

TABLE 3

| SAMPLE No. | SAME AS SAMPLE No. 11 EXCEPT FOR KIND OF M KIND OF M | Hcj (Oe) | Bs (A · m²/kg) | FIRST COATING PORTION MICRO-STRUCTURE | B (at %) | $D_1$ (nm) | SECOND COATING PORTION MICRO-STRUCTURE | B (at %) | $D_2$ (nm) | $D_2/D_1$ | $B_B/B_A$ |
|---|---|---|---|---|---|---|---|---|---|---|---|
| 11 | Nb | 2.6 | 170 | AMORPHOUS | 18.2 | 4 | CRYSTAL | 10.4 | 2 | 0.5 | 1.6 |
| 53 | Hf | 2.2 | 173 | AMORPHOUS | 15.5 | 3 | CRYSTAL | 8.5 | 3 | 1.0 | 1.3 |
| 54 | Zr | 2.3 | 171 | AMORPHOUS | 23.3 | 4 | CRYSTAL | 9.9 | 3 | 0.8 | 2.0 |
| 55 | Ta | 2.1 | 170 | AMORPHOUS | 13.3 | 5 | CRYSTAL | 11.2 | 3 | 0.6 | 2.1 |
| 56 | Mo | 2.4 | 167 | AMORPHOUS | 19.9 | 4 | CRYSTAL | 13.6 | 4 | 1.0 | 3.6 |
| 57 | W | 2.2 | 173 | AMORPHOUS | 23.5 | 3 | CRYSTAL | 14.4 | 3 | 1.0 | 2.3 |
| 58 | V | 2.2 | 168 | AMORPHOUS | 28.5 | 4 | CRYSTAL | 9.7 | 2 | 0.5 | 2.3 |
| 59 | Ti | 2.1 | 170 | AMORPHOUS | 24.2 | 3 | CRYSTAL | 11.2 | 2 | 0.7 | 2.0 |
| 60 | $Nb_{0.5}Hf_{0.5}$ | 2.3 | 169 | AMORPHOUS | 16.6 | 4 | CRYSTAL | 10.5 | 4 | 1.0 | 1.6 |
| 61 | $Zr_{0.5}Ta_{0.5}$ | 2.5 | 169 | AMORPHOUS | 16.9 | 3 | CRYSTAL | 13.5 | 3 | 1.0 | 1.7 |
| 62 | $Nb_{0.4}Hf_{0.3}Zr_{0.3}$ | 2.4 | 171 | AMORPHOUS | 20.2 | 4 | CRYSTAL | 12.4 | 2 | 0.5 | 1.8 |

From Table 3, even when the kind of the M element was changed, there was acquired soft magnetic metal powder including particles each having a structure in which the coating portion included the first coating portion and the second coating portion, and the first coating portion was closer to the soft magnetic metal portion than the second coating portion. Further, there was acquired soft magnetic metal powder containing particles each having a structure in which the first coating portion and the second coating portion had oxides including at least one element selected from Si, Fe and B as a main component, the first coating portion included only amorphous material, and the second coating portion included crystals.

Experimental Example 4

Soft magnetic metal powder was produced and evaluated in the same manner as that in the sample number 11 of Experimental Examples 1 and 2 except that the types and amounts of X1 and X2 elements were changed for the sample number 11 of Experimental Examples 1 and 2. Results are shown in Table 4. Note that all evaluations of ρ were A evaluations. Furthermore, it was confirmed that the coating portion included oxides containing Fe and B.

TABLE 4

| SAMPLE No. | $((Fe_{(1-(\alpha+\beta))}X1\alpha X2\beta)_{(1-(a+b+c+d+e+f))}M_aB_bP_cSi_dC_eS_f$ SAME AS SAMPLE No. 11 EXCEPT FOR KINDS OF X1 AND X2 X 1 | α {1 − (a + b + c + d + e + f)} | X 2 | β {1 − (a + b + c + d + e + f)} | Hcj (Oe) | Bs (A · m²/kg) | FIRST COATING PORTION MICRO-STRUCTURE | B (at %) | $D_1$ (nm) | SECOND COATING PORTION MICRO-STRUCTURE | B (at %) | $D_2$ (nm) | $D_2/D_1$ | $B_B/B_A$ |
|---|---|---|---|---|---|---|---|---|---|---|---|---|---|---|
| 11 | — | 0.000 | — | 0.000 | 2.6 | 170 | AMORPHOUS | 18.2 | 4 | CRYSTAL | 10.4 | 2 | 0.5 | 1.6 |
| 63 | Co | 0.100 | — | 0.000 | 3.3 | 173 | AMORPHOUS | 19.4 | 3 | CRYSTAL | 7.7 | 4 | 1.3 | 1.3 |

TABLE 4-continued

| | $((Fe_{(1-(\alpha+\beta))}X1_{\alpha}X2_{\beta})_{(1-(a+b+c+d+e+f))}M_aB_bP_cSi_dC_eS_f$ SAME AS SAMPLE No. 11 EXCEPT FOR KINDS OF X1 AND X2 | | | | | | FIRST COATING PORTION | | | SECOND COATING PORTION | | | | |
|---|---|---|---|---|---|---|---|---|---|---|---|---|---|---|
| SAMPLE No. | X 1 | α {1 − (a + b + c + d + e + f)} | X 2 | β {1 − (a + b + c + d + e + f)} | Hcj (Oe) | Bs (A · m²/kg) | MICROSTRUCTURE | B (at %) | $D_1$ (nm) | MICROSTRUCTURE | B (at %) | $D_2$ (nm) | $D_2/D_1$ | $B_B/B_A$ |
| 64 | Ni | 0.100 | — | 0.000 | 2.8 | 165 | AMORPHOUS | 16.5 | 3 | CRYSTAL | 11.2 | 3 | 1.0 | 1.6 |
| 65 | — | — | Al | 0.005 | 2.4 | 170 | AMORPHOUS | 13.6 | 6 | CRYSTAL | 12.3 | 3 | 0.5 | 1.6 |
| 66 | — | — | Zn | 0.005 | 2.5 | 167 | AMORPHOUS | 21.7 | 5 | CRYSTAL | 9.5 | 5 | 1.0 | 1.9 |
| 67 | — | — | Sn | 0.005 | 2.6 | 173 | AMORPHOUS | 22.2 | 7 | CRYSTAL | 10.6 | 2 | 0.3 | 2.4 |
| 68 | — | — | Cu | 0.005 | 2.2 | 166 | AMORPHOUS | 29.0 | 4 | CRYSTAL | 9.9 | 2 | 0.5 | 2.5 |
| 69 | — | — | Cr | 0.005 | 2.3 | 170 | AMORPHOUS | 23.2 | 4 | CRYSTAL | 12.4 | 2 | 0.5 | 2.1 |
| 70 | — | — | Bi | 0.005 | 2.4 | 173 | AMORPHOUS | 15.8 | 3 | CRYSTAL | 10.6 | 5 | 1.7 | 1.3 |
| 71 | — | — | La | 0.005 | 2.7 | 169 | AMORPHOUS | 14.3 | 3 | CRYSTAL | 14.6 | 3 | 1.0 | 1.6 |
| 72 | — | — | Y | 0.005 | 2.8 | 171 | AMORPHOUS | 21.3 | 3 | CRYSTAL | 8.5 | 2 | 0.7 | 1.9 |
| 73 | — | — | Mn | 0.005 | 2.9 | 166 | AMORPHOUS | 19.6 | 4 | CRYSTAL | 8.9 | 3 | 0.8 | 1.5 |
| 74 | — | — | Ag | 0.005 | 3.2 | 161 | AMORPHOUS | 23.1 | 5 | CRYSTAL | 11.3 | 2 | 0.4 | 2.3 |
| 75 | — | — | As | 0.005 | 3.1 | 162 | AMORPHOUS | 13.3 | 3 | CRYSTAL | 12.7 | 5 | 1.7 | 1.3 |
| 76 | — | — | Sb | 0.005 | 2.6 | 164 | AMORPHOUS | 15.5 | 4 | CRYSTAL | 7.9 | 6 | 1.5 | 1.1 |
| 77 | — | — | N | 0.005 | 2.9 | 168 | AMORPHOUS | 21.7 | 2 | CRYSTAL | 13.1 | 5 | 2.5 | 1.7 |
| 78 | — | — | O | 0.005 | 2.6 | 165 | AMORPHOUS | 15.1 | 3 | CRYSTAL | 11.8 | 2 | 0.7 | 1.4 |

From Table 4, even when the types of the X1 and X2 elements were changed, there was acquired soft magnetic metal powder including particles each having a structure in which the coating portion included the first coating portion and the second coating portion, and the first coating portion was closer to the soft magnetic metal portion than the second coating portion. Further, there was acquired soft magnetic metal powder containing particles each having a structure in which the first coating portion and the second coating portion had oxides including at least one element selected from Si, Fe and B as a main component, the first coating portion included only amorphous material, and the second coating portion included crystals.

Note that the microstructure of the soft magnetic metal portion was checked by using XRD and TEM for all the examples written in Tables 1 to 4. For all the examples on which no heat treatment was conducted, it was confirmed that the soft magnetic metal portion had a structure including only amorphous material or a nano-heterostructure. For all the examples on which the heat treatment was conducted, it was confirmed that the soft magnetic metal portion had a structure including only nanocrystals.

Experimental Example 5

In Experimental Example 5, an insulating coating including an $SiO_2$ glass coating or a phosphate glass coating was applied to soft magnetic alloy powder of sample numbers 6, 7, 8, 16, 17, and 18 by using a coating material made of powdered glass of types shown in Table 5 to form the third coating portion. The average value $D_3$ of the thickness of the third coating portion was set to about 20 nm. For each sample after coating, the concentration of B and the concentration of Si of each of the first and second coating portions, and the thicknesses ($D_1$, $D_2$, $D_3$) of the respective coating portions were measured in the same manner as in Experimental Examples 1 to 4. Table 5 shows test results of soft magnetic alloy powder before coating (sample numbers 6, 7, 8, 16, 17, 18). From Table 5, it was confirmed that the concentration of B and the concentration of Si of each coating portion, and the thickness of each coating portion did not change significantly before and after coating. Note that Table 5 also shows results of Experimental Example 6 and Sample number 121 described below for reference.

$P_2O_5$—ZnO—$R_2O$—$Al_2O_3$-based powdered glass used as the coating material in this example contained $P_2O_5$ of 50 mass %, ZnO of 12 mass %, $R_2O$ of 20 mass %, and $Al_2O_3$ of 6 mass %, and other components as a remaining part. Note that the present inventors also conducted a similar test on a case where $P_2O_5$-based glass having a composition different from that of the above-described $P_2O_5$—ZnO—$R_2O$—$Al_2O_3$-based powdered glass was used, and confirmed that a test result similar to a test result obtained in the case of use of the $P_2O_5$—ZnO—$R_2O$—$Al_2O_3$-based powdered glass described later was obtained.

$Bi_2O_3$—ZnO—$B_2O_3$—$SiO_2$-based powdered glass used as the coating material in this example contained $Bi_2O_3$ of 80 mass %, ZnO of 10 mass %, $B_2O_3$ of 5 mass %, and $SiO_2$ of 5 mass %. Note that the present inventors also conducted a similar test on a case where bismuthate-based glass having a composition different from that of the above-mentioned $Bi_2O_3$—ZnO—$B_2O_3$—$SiO_2$-based powdered glass was used, and confirmed that a test result similar to a test result obtained in the case of use of the $Bi_2O_3$—ZnO—$B_2O_3$—$SiO_2$-based powdered glass described later was obtained.

BaO—ZnO—$B_2O_3$—$SiO_2$—$Al_2O_3$-based powdered glass used as the coating material in this example contained BaO of 8 mass %, ZnO of 23 mass %, $B_2O_3$ of 19 mass %, $SiO_2$ of 16 mass %, and $Al_2O_3$ of 6 mass %, and other components as the remaining part. Note that the present inventors also conducted a similar test on a case where borosilicate-based glass having a composition different from that of the above-described BaO—ZnO—$B_2O_3$—$SiO_2$—$Al_2O_3$-based powdered glass was used, and confirmed that a test result similar to a test result obtained in the case of use of the BaO—ZnO—$B_2O_3$—$SiO_2$—$Al_2O_3$-based powdered glass described later was obtained.

The powder resistivity and the coercivity Hcj of the soft magnetic alloy powder after the third coating portion was formed were measured. With respect to the powder resistivity, unlike Tables 1 to 4, the measured values thereof are shown in Table 5.

TABLE 5

| SAMPLE No. | EXAMPLE/ COMPARATIVE EXAMPLE | POWDER BEFORE COATING | FIRST COATING PORTION | | | | SECOND COATING PORTION | | | | | | | THIRD COATING PORTION | | POWDER RESISTIVITY | |
|---|---|---|---|---|---|---|---|---|---|---|---|---|---|---|---|---|---|
| | | | MICRO-STRUCTURE | B (at %) | Si (at %) | $D_1$ (nm) | MICRO-STRUCTURE | B (at %) | Si (at %) | $D_2$ (nm) | $D_2/D_1$ | $B_B/B_A$ | $Si_B/Si_A$ | COATING MATERIAL | $D_3$ (nm) | at 0.6 t/cm$^2$ (Ω · cm) | Hcj (Oe) |
| 6 | EXAMPLE | SAMPLE No. 6 | AMORPHOUS | 30.9 | 40.1 | 3 | CRYSTAL + AMORPHOUS | 35.6 | 28.8 | 3 | 1.0 | 3.7 | 2.4 | NONE | 0 | $6.0 \times 10^2$ | 1.0 |
| 101 | EXAMPLE | SAMPLE No. 6 | AMORPHOUS | 28.8 | 39.2 | 3 | CRYSTAL + AMORPHOUS | 33.8 | 29.2 | 2 | 0.7 | 3.4 | 2.7 | $P_2O_5$—ZnO—$R_2O$—$Al_2O_3$ | 19 | $4.0 \times 10^8$ | 1.1 |
| 102 | EXAMPLE | SAMPLE No. 6 | AMORPHOUS | 31.8 | 41.2 | 3 | CRYSTAL + AMORPHOUS | 35.9 | 27.7 | 2 | 0.7 | 3.5 | 2.5 | $Bi_2O_3$—ZnO—$B_2O_3$—$SiO_2$ | 22 | $1.0 \times 10^8$ | 1.1 |
| 103 | EXAMPLE | SAMPLE No. 6 | AMORPHOUS | 32.0 | 41.7 | 4 | CRYSTAL + AMORPHOUS | 36.3 | 30.0 | 4 | 1.0 | 4.0 | 2.8 | BaO—ZnO—$B_2O_3$—$SiO_2$—$Al_2O_3$ | 20 | $3.0 \times 10^8$ | 1.2 |
| 7 | EXAMPLE | SAMPLE No. 7 | AMORPHOUS | 28.5 | 13.7 | 4 | CRYSTAL + AMORPHOUS | 29.7 | 12.2 | 2 | 0.5 | 3.1 | 1.0 | NONE | 0 | $3.0 \times 10^2$ | 1.1 |
| 104 | EXAMPLE | SAMPLE No. 7 | AMORPHOUS | 27.5 | 13.8 | 3 | CRYSTAL + AMORPHOUS | 29.9 | 11.5 | 3 | 1.0 | 3.2 | 1.1 | $P_2O_5$—ZnO—$R_2O$—$Al_2O_3$ | 21 | $7.0 \times 10^8$ | 1.2 |
| 105 | EXAMPLE | SAMPLE No. 7 | AMORPHOUS | 30.1 | 14.9 | 4 | CRYSTAL + AMORPHOUS | 31.1 | 11.8 | 2 | 0.5 | 3.5 | 0.9 | $Bi_2O_3$—ZnO—$B_2O_3$—$SiO_2$ | 20 | $3.0 \times 10^8$ | 1.3 |
| 106 | EXAMPLE | SAMPLE No. 7 | AMORPHOUS | 29.2 | 15.1 | 3 | CRYSTAL + AMORPHOUS | 30.5 | 12.1 | 3 | 1.0 | 3.1 | 0.9 | BaO—ZnO—$B_2O_3$—$SiO_2$—$Al_2O_3$ | 18 | $5.0 \times 10^8$ | 1.2 |
| 8 | EXAMPLE | SAMPLE No. 8 | AMORPHOUS | 25.3 | 7.3 | 5 | CRYSTAL + AMORPHOUS | 26.3 | 4.7 | 2 | 0.4 | 2.8 | 0.5 | NONE | 0 | $2.0 \times 10$ | 1.0 |
| 107 | EXAMPLE | SAMPLE No. 8 | AMORPHOUS | 24.8 | 7.0 | 4 | CRYSTAL + AMORPHOUS | 24.9 | 5.6 | 3 | 0.8 | 2.7 | 0.5 | $P_2O_5$—ZnO—$R_2O$—$Al_2O_3$ | 20 | $3.0 \times 10^9$ | 1.1 |
| 108 | EXAMPLE | SAMPLE No. 8 | AMORPHOUS | 25.5 | 8.8 | 5 | CRYSTAL + AMORPHOUS | 27.8 | 4.4 | 2 | 0.4 | 2.9 | 0.6 | $Bi_2O_3$—ZnO—$B_2O_3$—$SiO_2$ | 21 | $1.0 \times 10^9$ | 1.2 |
| 109 | EXAMPLE | SAMPLE No. 8 | AMORPHOUS | 25.9 | 7.7 | 4 | CRYSTAL + AMORPHOUS | 26.1 | 4.9 | 2 | 0.5 | 3.0 | 0.7 | BaO—ZnO—$B_2O_3$—$SiO_2$—$Al_2O_3$ | 19 | $2.0 \times 10^9$ | 1.1 |
| 16 | EXAMPLE | SAMPLE No. 16 | AMORPHOUS | 15.2 | — | 3 | CRYSTAL | 8.8 | — | 5 | 1.7 | 1.1 | — | NONE | 0 | $9.0 \times 10^2$ | 2.4 |
| 110 | EXAMPLE | SAMPLE No. 16 | AMORPHOUS | 15.9 | — | 4 | CRYSTAL | 8.0 | — | 4 | 1.0 | 1.4 | — | $P_2O_5$—ZnO—$R_2O$—$Al_2O_3$ | 20 | $8.0 \times 10^9$ | 2.6 |
| 121 | EXAMPLE | SAMPLE No. 16 | AMORPHOUS | 15.2 | — | 3 | CRYSTAL | 9.0 | — | 4 | 1.3 | 1.4 | — | $P_2O_5$—ZnO—$R_2O$—$Al_2O_3$ | 41 | $3.0 \times 10^{10}$ | 3.0 |
| 111 | EXAMPLE | SAMPLE No. 16 | AMORPHOUS | 14.6 | — | 3 | CRYSTAL | 8.4 | — | 6 | 2.0 | 1.1 | — | $Bi_2O_3$—ZnO—$B_2O_3$—$SiO_2$ | 19 | 5.0 × 109 | 2.6 |

TABLE 5-continued

| SAMPLE No. | EXAMPLE/ COMPARATIVE EXAMPLE | POWDER BEFORE COATING | FIRST COATING PORTION | | | | SECOND COATING PORTION | | | | | | | THIRD COATING PORTION | | POWDER RESISTIVITY | |
|---|---|---|---|---|---|---|---|---|---|---|---|---|---|---|---|---|---|
| | | | MICRO-STRUCTURE | B (at %) | Si (at %) | $D_1$ (nm) | MICRO-STRUCTURE | B (at %) | Si (at %) | $D_2$ (nm) | $D_2/D_1$ | $B_B/B_A$ | $Si_B/Si_A$ | COATING MATERIAL | $D_3$ (nm) | at 0.6 t/cm$^2$ (Ω · cm) | Hcj (Oe) |
| 112 | EXAMPLE | SAMPLE No. 16 | AMORPHOUS | 14.1 | — | 4 | CRYSTAL | 7.7 | — | 6 | 1.5 | 1.2 | — | $BaO—ZnO—B_2O_3—SiO_2—Al_2O_3$ | 21 | 6.0 × 109 | 2.7 |
| 17 | EXAMPLE | SAMPLE No. 17 | AMORPHOUS | 10.6 | — | 3 | CRYSTAL | 7.5 | — | 4 | 1.3 | 1.0 | — | NONE | 0 | $4.0 \times 10^2$ | 2.2 |
| 113 | EXAMPLE | SAMPLE No. 17 | AMORPHOUS | 11.5 | — | 3 | CRYSTAL | 7.9 | — | 5 | 1.7 | 1.2 | — | $P_2O_5—ZnO—R_2O—Al_2O_3$ | 19 | $6.0 \times 10^9$ | 2.4 |
| 114 | EXAMPLE | SAMPLE No. 17 | AMORPHOUS | 9.7 | — | 2 | CRYSTAL | 6.9 | — | 4 | 2.0 | 1.0 | — | $Bi_2O_3—ZnO—B_2O_3—SiO_2$ | 20 | $2.0 \times 10^9$ | 2.5 |
| 115 | EXAMPLE | SAMPLE No. 17 | AMORPHOUS | 10.3 | — | 4 | CRYSTAL | 6.8 | — | 3 | 0.8 | 1.1 | — | $BaO—ZnO—B_2O_3—SiO_2—Al_2O_3$ | 22 | $4.0 \times 10^9$ | 2.4 |
| 18 | EXAMPLE | SAMPLE No. 18 | AMORPHOUS | 8.5 | — | 2 | CRYSTAL | 2.7 | — | 5 | 2.5 | 0.5 | — | NONE | 0 | 3.0 × 10 | 2.3 |
| 116 | EXAMPLE | SAMPLE No. 18 | AMORPHOUS | 9.0 | — | 2 | CRYSTAL | 2.3 | — | 4 | 2.0 | 0.6 | — | $P_2O_5—ZnO—R_2O—Al_2O_3$ | 20 | $4.0 \times 10^8$ | 2.5 |
| 117 | EXAMPLE | SAMPLE No. 18 | AMORPHOUS | 9.8 | — | 2 | CRYSTAL | 3.1 | — | 5 | 2.5 | 0.5 | — | $Bi_2O_3—ZnO—B_2O_3—SiO_2$ | 19 | $9.0 \times 10^7$ | 2.6 |
| 118 | EXAMPLE | SAMPLE No. 18 | AMORPHOUS | 8.6 | — | 3 | CRYSTAL | 3.2 | — | 5 | 1.7 | 0.6 | — | $BaO—ZnO—B_2O_3—SiO_2—Al_2O_3$ | 19 | $3.0 \times 10^8$ | 2.5 |

From Table 5, soft magnetic alloy powder of sample numbers 101 to 109 having the third coating portion formed therein had greatly enhanced powder resistivity as compared with soft magnetic alloy powder of sample numbers 6 to 8 of Experimental Example 1 produced in the same method except that no third coating portion was formed. Further, soft magnetic alloy powder of sample numbers 110 to 118 and 121 having the third coating portion formed therein had a greatly enhanced powder resistivity as compared with soft magnetic alloy powder of sample numbers 16 to 18 of Experimental Example 1 produced by the same method except that no third coating portion was formed.

Further, soft magnetic alloy powder in which $B_B/B_A$ was not less than 1.0 and not more than 3.0 had increased powder resistivity as compared with soft magnetic alloy powder having the same composition, microstructure, and coating material except that $B_B/B_A$ was out of the above-mentioned range.

Experimental Example 6

In Experimental Example 6, coating was further applied to the soft magnetic alloy powder of sample number 112 of Experimental Example 5 by using $P_2O_5$—ZnO—$R_2O$—$Al_2O_3$-based powdered glass as a coating material. As a result, soft magnetic alloy powder of sample number 120 in which the third coating portion included two layers of a layer made of BaO—ZnO—$B_2O_3$—$SiO_2$—$Al_2O_3$ and a layer made of $P_2O_5$—ZnO—$R_2O$—$Al_2O_3$ was obtained. Note that the average value of the thickness of the layer made of $P_2O_5$—ZnO—$R_2O$—$Al_2O_3$ was set to about 20 nm, and the average value of the thickness of the layer made of BaO—ZnO—$B_2O_3$—$SiO_2$—$Al_2O_3$ was set to about 20 nm. For comparison with the soft magnetic alloy powder of sample number 120, the soft magnetic alloy powder of sample number 121 was produced under the same condition as that of sample number 110 except that $D_3$ was set to about 40 nm. A result is shown in Table 6.

TABLE 6

| SAMPLE No. | EXAMPLE/ COMPARATIVE EXAMPLE | POWDER BEFORE $P_2O_5$—ZnO—$R_2O$—$Al_2O_3$ COATING | FIRST COATING PORTION MICRO-STRUCTURE | B (at %) | $D_1$ (nm) | SECOND COATING PORTION MICRO-STRUCTURE | B (at %) | $D_2$ (nm) | $D_2/D_1$ |
|---|---|---|---|---|---|---|---|---|---|
| 120 | EXAMPLE | SAMPLE NUMBER 112 | AMORPHOUS | 16.3 | 3 | CRYSTAL | 8.3 | 3 | 1.0 |
| 121 | EXAMPLE | SAMPLE NUMBER 16 | AMORPHOUS | 15.2 | 3 | CRYSTAL | 9.0 | 4 | 1.3 |

| SAMPLE No. | $B_B/B_A$ | BaO—ZnO—$B_2O_3$—$SiO_2$—$Al_2O_3$ COATING THICKNESS (nm) | $P_2O_5$—ZnO—$R_2O$—$Al_2O_3$ COATING THICKNESS (nm) | TOTAL COATING THICKNESS $D_3$ (nm) | RESISTIVITY OF COATING POWDER at 0.6 t/cm$^2$ (Ω · cm) | Hcj (Oe) |
|---|---|---|---|---|---|---|
| 120 | 1.5 | 21 | 19 | 40 | $9.0 \times 10^{10}$ | 2.9 |
| 121 | 1.4 | 0 | 41 | 41 | $3.0 \times 10^{10}$ | 3.0 |

From Table 6, the soft magnetic alloy powder of sample number 120 in which the third coating portion was formed of two layers had higher powder resistivity as compared with the soft magnetic alloy powder of sample number 121 having a configuration similar to the configuration of sample number 120 except that the third coating portion was formed of only one layer.

Sample number 121 has a structure in which BaO—ZnO—$B_2O_3$—$SiO_2$—$Al_2O_3$ of sample number 120 is replaced with $P_2O_5$—ZnO—$R_2O$—$Al_2O_3$. Here, from the sample numbers 110 and 112 in Table 5, it is considered that $P_2O_5$—ZnO—$R_2O$—$Al_2O_3$ has a greater effect of increasing the powder resistivity of the soft magnetic alloy powder than BaO—ZnO—$B_2O_3$—$SiO_2$—$Al_2O_3$. From this point, it is considered that sample number 121 increases the powder resistivity as compared with sample number 120. However, actually, sample number 120 increases the powder resistivity as compared with sample number 121. This is because the powder resistivity is improved by forming the third coating portion of two layers.

DESCRIPTION OF THE REFERENCE NUMERAL

1 particle
11 soft magnetic metal portion
13 coating portion
**13*a*** first coating portion
**13*b*** second coating portion
15 resin
20 molten metal supply unit
21 molten metal
22 container
24 heating coil
26 gas injection nozzle
30 cooling unit
32 cylindrical body
33 inner surface (inner peripheral surface)
34 discharge portion
36 coolant lead-in portion (coolant lead-out portion)
37 nozzle
38 frame body
40 partition portion
42 passage portion
44 external portion (outer space portion)
46 internal portion (inner space portion)
50 coolant flow
52 coolant discharge portion
100 metal powder manufacturing apparatus

What is claimed is:

1. A soft magnetic metal powder containing Fe, wherein the soft magnetic metal powder comprises particles each including a soft magnetic metal portion, and a coating portion coating the soft magnetic metal portion;

the coating portion comprises a first coating portion and a second coating portion;

the first coating portion is closer to the soft magnetic metal portion than the second coating portion;

the first coating portion and the second coating portion each include oxides as a main component, and the oxides contain at least one element selected from Si, Fe, and B;

the first coating portion includes amorphous material, and the second coating portion includes crystals;

the second coating portion has a higher crystal content ratio than the first coating portion;

the soft magnetic metal powder contains B, and $1.0 \leq B_B/B_A \leq 5.5$ is satisfied, in which an average value of an atomic concentration of B in the soft magnetic metal portion is represented by $B_A$, and an average value of an atomic concentration of B in the first coating portion and the second coating portion is represented by $B_B$.

2. The soft magnetic metal powder according to claim 1, wherein the soft magnetic metal portion includes amorphous material.

3. The soft magnetic metal powder according to claim 1, wherein the soft magnetic metal portion includes nanocrystals.

4. The soft magnetic metal powder according to claim 1, wherein $0.2 \leq D_2/D_1 \leq 8.0$ is satisfied, in which an average value in thickness of the first coating portion is represented by $D_1$, and an average value in thickness of the second coating portion is represented by $D_2$.

5. The soft magnetic metal powder according to claim 1, wherein the coating portion further comprises a third coating portion outside the second coating portion.

6. The soft magnetic metal powder according to claim 1, wherein the soft magnetic metal powder contains Si, and $0.5 \leq Si_B/Si_A \leq 50$ is satisfied, in which an average value of an atomic concentration of Si in the soft magnetic metal portion is represented by $Si_A$, and an average value of an atomic concentration of Si in the first coating portion and the second coating portion is represented by $Si_B$.

7. The soft magnetic metal powder according to claim 6, wherein $0.8 \leq Si_B/Si_A \leq 19.2$ is satisfied.

8. A magnetic component comprising the soft magnetic metal powder according to claim 1.

* * * * *